US008720605B2

(12) United States Patent
Sheppard et al.

(10) Patent No.: US 8,720,605 B2
(45) **Date of Patent: *May 13, 2014**

(54) SYSTEM FOR DIRECTIONALLY DRILLING A BOREHOLE WITH A ROTARY DRILLING SYSTEM

(75) Inventors: Michael Charles Sheppard, Hadstock (GB); Ashley Bernard Johnson, Milton (GB); Geoff Downton, Minchinhampton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/324,681

(22) Filed: Dec. 13, 2011

(65) Prior Publication Data

US 2012/0080235 A1 Apr. 5, 2012

Related U.S. Application Data

(60) Division of application No. 12/116,408, filed on May 7, 2008, now Pat. No. 8,534,380, which is a continuation-in-part of application No. 11/839,381, filed on Aug. 15, 2007.

(51) Int. Cl.
*E21B 7/04* (2006.01)

(52) U.S. Cl.
USPC ..... 175/61; 175/76; 175/73

(58) Field of Classification Search
USPC ..... 175/24, 26, 55, 56, 263, 266, 61, 67, 175/63, 73
See application file for complete search history.

(56) References Cited

U.S. PATENT DOCUMENTS

| | | | |
|---|---|---|---|
| 1,156,147 | A | 10/1915 | Karns |
| 1,638,337 | A | 8/1927 | Hutton |
| 1,667,155 | A | 4/1928 | Higdon |
| 2,010,789 | A | 8/1935 | Roesel |
| 2,016,042 | A | 10/1935 | Lewis |

(Continued)

FOREIGN PATENT DOCUMENTS

| | | | |
|---|---|---|---|
| BE | 1012545 | A3 | 12/2000 |
| EP | 0530045 | B1 | 3/1993 |

(Continued)

OTHER PUBLICATIONS

Office Action of Chinese Application No. 200880111732.0 dated Apr. 12, 2013: pp. 1-3.

(Continued)

*Primary Examiner* — James Sayre

(57) ABSTRACT

This disclosure relates in general to a method and a system for directionally drilling a borehole with a rotary drilling system. More specifically, but not by way of limitation, methods and system provide for controlling motion of the rotary drilling system in the borehole when a side force is applied to the drilling system to bias or focus the motion so that the drilling system directionally drills the borehole through an earth formation. In certain aspects, side cutting of a sidewall of the borehole by a drill bit under an applied side force is controlled by a geostationary element to provide for directional side cutting and, as a result, directional drilling of the borehole through the earth formation. In other aspects, a non-concentrically coupled gauge pad assembly may rotate with the drilling system and bias or focus the applied side force.

11 Claims, 7 Drawing Sheets

(56) References Cited

U.S. PATENT DOCUMENTS

| | | | | |
|---|---|---|---|---|
| 2,238,377 | A | 4/1941 | Strang | |
| 2,670,046 | A | 2/1954 | Kinzbach | |
| 3,224,513 | A | 12/1965 | Weeden, Jr. | |
| 3,285,349 | A | 11/1966 | Brandon | |
| 4,190,123 | A | 2/1980 | Roddy | |
| 4,211,292 | A | 7/1980 | Evans | |
| 4,319,649 | A | 3/1982 | Jeter | |
| 4,394,193 | A | 7/1983 | Gfrerer | |
| 4,690,229 | A | 9/1987 | Raney | |
| 4,739,843 | A | 4/1988 | Burton | |
| 4,775,017 | A | 10/1988 | Forrest et al. | |
| 4,807,708 | A | 2/1989 | Forrest et al. | |
| 4,842,083 | A | 6/1989 | Raney | |
| 4,856,601 | A | 8/1989 | Raney | |
| 5,010,789 | A | 4/1991 | Brett et al. | |
| 5,042,596 | A | 8/1991 | Brett et al. | |
| 5,090,492 | A | 2/1992 | Keith | |
| 5,113,953 | A | 5/1992 | Noble | |
| 5,159,577 | A | 10/1992 | Twist | |
| 5,163,524 | A | 11/1992 | Newton, Jr. et al. | |
| 5,213,168 | A | 5/1993 | Warren et al. | |
| 5,265,682 | A | 11/1993 | Russell et al. | |
| 5,339,910 | A | 8/1994 | Mueller | |
| 5,341,886 | A | 8/1994 | Patton | |
| 5,343,964 | A | 9/1994 | Leroy | |
| 5,361,859 | A | 11/1994 | Tibbitts | |
| 5,423,389 | A | 6/1995 | Warren et al. | |
| 5,490,569 | A | 2/1996 | Brotherton et al. | |
| 5,520,255 | A | 5/1996 | Barr et al. | |
| 5,553,678 | A | 9/1996 | Barr et al. | |
| 5,553,679 | A | 9/1996 | Thorp | |
| 5,560,440 | A | 10/1996 | Tibbitts | |
| 5,582,259 | A | 12/1996 | Barr | |
| 5,603,385 | A | 2/1997 | Colebrook | |
| 5,641,421 | A | 6/1997 | Manov et al. | |
| 5,649,604 | A | 7/1997 | Fuller et al. | |
| 5,651,421 | A | 7/1997 | Newton et al. | |
| 5,673,763 | A | 10/1997 | Thorp | |
| 5,685,379 | A | 11/1997 | Barr et al. | |
| 5,695,015 | A | 12/1997 | Barr et al. | |
| 5,697,461 | A | 12/1997 | Newton et al. | |
| 5,706,905 | A | 1/1998 | Barr | |
| 5,778,992 | A * | 7/1998 | Fuller | 175/73 |
| 5,803,185 | A | 9/1998 | Barr et al. | |
| 5,803,196 | A | 9/1998 | Fielder | |
| 5,836,406 | A | 11/1998 | Schuh | |
| 5,971,085 | A | 10/1999 | Colebrook | |
| 5,979,577 | A | 11/1999 | Fielder | |
| 6,089,332 | A | 7/2000 | Barr et al. | |
| 6,092,610 | A | 7/2000 | Kosmala et al. | |
| 6,142,250 | A | 11/2000 | Griffin et al. | |
| 6,158,529 | A | 12/2000 | Dorel | |
| 6,244,361 | B1 | 6/2001 | Comeau et al. | |
| 6,257,356 | B1 | 7/2001 | Wassell | |
| 6,290,007 | B2 | 9/2001 | Beuershausen et al. | |
| 6,360,831 | B1 | 3/2002 | Akesson et al. | |
| 6,364,034 | B1 | 4/2002 | Schoeffler | |
| 6,394,193 | B1 | 5/2002 | Askew | |
| 6,427,792 | B1 | 8/2002 | Roberts et al. | |
| 6,601,658 | B1 | 8/2003 | Downton | |
| 6,604,658 | B1 | 8/2003 | Young et al. | |
| 6,629,476 | B2 | 10/2003 | Fielder et al. | |
| 6,904,984 | B1 | 6/2005 | Estes et al. | |
| 6,971,459 | B2 | 12/2005 | Raney | |
| 7,090,037 | B2 | 8/2006 | Best | |
| 7,201,237 | B2 | 4/2007 | Raney | |
| 7,287,604 | B2 | 10/2007 | Aronstam et al. | |
| 7,308,955 | B2 | 12/2007 | Barton et al. | |
| 7,757,784 | B2 | 7/2010 | Fincher et al. | |
| 7,762,356 | B2 | 7/2010 | Turner et al. | |
| 7,845,430 | B2 | 12/2010 | Johnson et al. | |
| 7,971,661 | B2 | 7/2011 | Johnson et al. | |
| 7,971,662 | B2 | 7/2011 | Beuerhausen | |
| 8,066,085 | B2 | 11/2011 | Johnson et al. | |
| 8,087,479 | B2 | 1/2012 | Kulkarni et al. | |
| 2001/0052428 | A1 | 12/2001 | Larronde et al. | |
| 2002/0011359 | A1 | 1/2002 | Webb et al. | |
| 2002/0020565 | A1 | 2/2002 | Hart et al. | |
| 2002/0053470 | A1 | 5/2002 | Noe et al. | |
| 2002/0088649 | A1 | 7/2002 | Morris, Sr. et al. | |
| 2003/0056991 | A1 | 3/2003 | Hahn et al. | |
| 2004/0099444 | A1 | 5/2004 | Chen et al. | |
| 2004/0216921 | A1 | 11/2004 | Krueger | |
| 2005/0020565 | A1 | 1/2005 | Jones et al. | |
| 2005/0056463 | A1 * | 3/2005 | Aronstam et al. | 175/61 |
| 2005/0236187 | A1 | 10/2005 | Chen et al. | |
| 2005/0269082 | A1 * | 12/2005 | Baron et al. | 166/255.2 |
| 2006/0157277 | A1 * | 7/2006 | Bittar et al. | 175/26 |
| 2006/0196697 | A1 | 9/2006 | Raney | |
| 2006/0237234 | A1 | 10/2006 | Dennis et al. | |
| 2006/0249287 | A1 | 11/2006 | Downton et al. | |
| 2007/0007000 | A1 | 1/2007 | Dewey et al. | |
| 2007/0205022 | A1 | 9/2007 | Treviranus et al. | |
| 2007/0272445 | A1 | 11/2007 | Cariveau et al. | |
| 2008/0000693 | A1 | 1/2008 | Hutton | |
| 2008/0115974 | A1 | 5/2008 | Johnson et al. | |
| 2009/0044977 | A1 | 2/2009 | Johnson et al. | |
| 2009/0044979 | A1 | 2/2009 | Johnson et al. | |
| 2009/0044980 | A1 | 2/2009 | Sheppard et al. | |
| 2009/0044981 | A1 | 2/2009 | Sheppard et al. | |
| 2009/0065262 | A1 | 3/2009 | Downton et al. | |
| 2009/0188720 | A1 | 7/2009 | Johnson et al. | |
| 2009/0194334 | A1 | 8/2009 | Johnson et al. | |
| 2010/0038141 | A1 | 2/2010 | Johnson et al. | |
| 2012/0018224 | A1 | 1/2012 | Johnson et al. | |
| 2012/0090897 | A1 | 4/2012 | Johnson et al. | |

FOREIGN PATENT DOCUMENTS

| | | | |
|---|---|---|---|
| EP | 0707131 | B1 | 4/1996 |
| EP | 1227214 | B1 | 7/2002 |
| GB | 2257182 | A | 1/1993 |
| GB | 2285651 | A | 7/1995 |
| GB | 2304759 | A | 3/1997 |
| GB | 2343470 | A | 5/2000 |
| GB | 2355744 | A | 5/2001 |
| GB | 2367626 | A | 4/2002 |
| GB | 2425790 | A | 5/2005 |
| GB | 2408526 | A | 6/2005 |
| GB | 2423102 | A | 8/2006 |
| GB | 2423546 | A | 8/2006 |
| GB | 2439661 | A | 1/2008 |
| RU | 2006560 | C1 | 1/1994 |
| RU | 2029047 | C1 | 2/1995 |
| RU | 2072419 | C1 | 1/1997 |
| RU | 2100559 | C1 | 12/1997 |
| RU | 2239042 | C2 | 10/2004 |
| RU | 2006100565 | A | 7/2007 |
| WO | 9619635 | A1 | 6/1996 |
| WO | 9747848 | A1 | 12/1997 |
| WO | 9815710 | A1 | 4/1998 |
| WO | 9928587 | A1 | 6/1999 |
| WO | 0121927 | A2 | 3/2001 |
| WO | 0236924 | A2 | 5/2002 |
| WO | 03004824 | A1 | 1/2003 |
| WO | 03052237 | A1 | 6/2003 |
| WO | 03097989 | A1 | 11/2003 |
| WO | 2004104360 | A2 | 11/2004 |
| WO | 2004113664 | A1 | 12/2004 |
| WO | 2006012186 | A1 | 2/2006 |
| WO | 2007012858 | A1 | 2/2007 |
| WO | 2007036722 | | 4/2007 |

OTHER PUBLICATIONS

Dictionary definition of "geostationary" accessed Feb. 24, 2012: p. 1, <http://www.thefreedictionary.com/p/geostationary>.

* cited by examiner 57
59B
59A 63
21
61
23
50
24A
20
55A
55
24B
54
59A
15
57
59B
57
17
53
70
65

73
74B
74A
89

81
82

79
86
θ
85
24
50
20
73
15
76
83
82A
82
79
81
17
70
80
53
24

SYSTEM FOR DIRECTIONALLY DRILLING A BOREHOLE WITH A ROTARY DRILLING SYSTEM

CROSS-REFERENCE TO RELATED APPLICATIONS

This application is a divisional of co-pending U.S. patent application Ser. No. 12/116,408 filed May 7, 2008, which is a continuation-in-part of co-pending U.S. patent application Ser. No. 11/839,381 filed Aug. 15, 2007; both of which are incorporated herein by reference in their entirety.

BACKGROUND

This disclosure relates in general to a method and a system for directionally drilling a borehole with a rotary drilling system. More specifically, but not by way of limitation, an embodiment of the present invention provides for controlling motion of the rotary drilling system in the borehole when a side force is applied to the drilling system so that the drilling system directionally drills the borehole through an earth formation. In certain aspects of the present invention, side cutting of a sidewall of the borehole by a drill bit under an applied side force is controlled by a geostationary element to provide for directional side cutting and, as a result, directional drilling of the borehole through the earth formation.

In many industries, it is often desirable to directionally drill a borehole through an earth formation or core a hole in subsurface formations in order that the borehole and/or coring may circumvent and/or pass through deposits and/or reservoirs in the formation to reach a predefined objective in the formation and/or the like. When drilling or coring holes in sub-surface formations, it is sometimes desirable to be able to vary and control the direction of drilling, for example to direct the borehole towards a desired target, or control the direction horizontally within an area containing hydrocarbons once the target has been reached. It may also be desirable to correct for deviations from the desired direction when drilling a straight hole, or to control the direction of the hole to avoid obstacles, such as formations with adverse drilling properties. It should be understood that drilling of boreholes may comprise vertical drilling, horizontal drilling and angled drilling and many drilling jobs may include combinations thereof.

In the hydrocarbon industry for example, a borehole may be drilled so as to intercept a particular subterranean-formation at a particular location. In some drilling processes, to drill the desired borehole, a drilling trajectory through the earth formation may be pre-planned and the drilling system may be controlled to conform to the trajectory. In other processes, or in combination with the previous process, an objective for the borehole may be determined and the progress of the borehole being drilled in the earth formation may be monitored during the drilling process and steps may be taken to ensure the borehole attains the target objective. Furthermore, operation of the drill system may be controlled to provide for economic drilling, which may comprise drilling so as to bore through the earth formation as quickly as possible, drilling so as to reduce bit wear, drilling so as to achieve optimal drilling through the earth formation and optimal bit wear and/or the like.

One aspect of the drilling process may be referred to as "directional drilling." Directional drilling is the intentional deviation of the borehole/wellbore from the path it would naturally take. In other words, directional drilling is the steering of the drill string so that it travels in a desired direction.

Directional drilling may be advantageous in situations such as offshore drilling or the like because it may enables a plurality of wells to be drilled from a single drilling platform. Directional drilling may also enable horizontal drilling through a reservoir to provide for enhanced exposure of a borehole to the reservoir, i.e., horizontal drilling enables may provide for a longer length of the wellbore to traverse the reservoir, thus increasing the production rate from the well.

A directional drilling system may also be useful in vertical-type drilling operation. For example, in a vertical drilling operation, the drill bit may veer off of a planned vertical drilling trajectory because of the unpredictable nature of the formations being penetrated and/or the varying forces that the drill bit experiences. When such a deviation occurs, a directional drilling system may be used to put the drill bit back on a vertical course.

The monitoring process for directional drilling of the borehole may include determining the location of the drill bit in the earth formation, determining an orientation of the drill bit in the earth formation, determining a weight-on-bit of the drilling system, determining a speed of drilling through the earth formation, determining properties of the earth formation being drilled, determining properties of a subterranean formation surrounding the drill bit, looking forward to ascertain properties of formations ahead of the drill bit, seismic analysis of the earth formation, determining properties of reservoirs etc. proximal to the drill bit, measuring pressure, temperature and/or the like in the borehole and/or surrounding the borehole and/or the like. In any process for directional drilling of a borehole, whether following a pre-planned trajectory, monitoring the drilling process and/or the drilling conditions and/or the like, it is necessary to be able to steer the drilling system.

Forces which act on the drill bit during a drilling operation include gravity, torque developed by the bit, the end load applied to the bit, and the bending moment from the drill assembly. These forces together with the type of strata being drilled and the inclination of the strata to the bore hole may create a complex interactive system of forces during the drilling process.

In many applications, the drilling system may comprise a "rotary drilling" system in which a downhole assembly, including a drill bit, is connected to a drill string (casing string) that may be driven/rotated from the drilling platform. In a rotary drilling system, directional drilling of the borehole may be provided by varying factors such as weight-on-bit, the rotation speed, etc.

With regards to rotary drilling, known methods of directional drilling include the use of a rotary steerable system ("RSS"). In an RSS, the drill string is rotated from the surface causing the drill bit to rotate against an earth formation at the end of the borehole and to drill through the formation. Downhole devices and systems, such as discussed below, may be activated to cause the drill bit to drill in a desired direction. Rotating the drill string greatly reduces the occurrences of the drill string getting hung up or stuck during drilling.

Rotary steerable drilling systems for directionally drilling boreholes through the earth may be generally classified as either "point-the-bit" systems or "push-the-bit" systems. In both types of system the goal of the system is to apply a side force to the drill bit so as to cause the drill bit to drill directionally, i.e., off axis.

In the point-the-bit system, the axis of rotation of the drill bit is deviated from the local axis of the bottomhole assembly ("BHA") in the general direction of the new hole. The term bottomhole assembly may be used to refer to the plurality of devices/systems attached to the drill string in the borehole. As such, the bottomhole assembly may comprise the drill bit, a drill collars, gauge pads, bit sub, a mud motor, stabilizers, heavy-weight drillpipe, jarring devices ("jars") and cross-overs and/or the like.

In general, the borehole may be propagated/drilled in accordance with the customary three-point geometry defined by upper and lower stabilizer touch points and the drill bit. The angle of deviation of the drill bit axis coupled with a finite distance between the drill bit and lower stabilizer results in a non-collinear condition required for a curve to be generated. There are many ways in which this may be achieved including a fixed bend at a point in the bottomhole assembly close to the lower stabilizer or a flexure of the drill bit drive shaft distributed between the upper and lower stabilizer. By managing the stabilizer positions, introduction of an angled sub between the stabilizers, the amount of flexibility and location of a flexure and/or the like directional drilling may be attained, i.e., a side force may generated on the drill bit causing off axis drilling of the borehole.

Pointing the bit may comprise using a downhole motor to rotate/move the drill bit in the borehole. For example, the drill bit, the motor and drill bit may be mounted upon a drill string that includes an angled bend and the motor may rotate the drill bit tom provide that the angles bend causes a side force to be applied to the drill bit and, consequently, the drilling of the borehole by the drill bit in the direction of the side force. In such a system, the drill bit may be coupled to the motor by a hinge-type or tilted mechanism/joint, a bent sub or the like, wherein the drill bit may be moved so that is inclined relative to the motor. When variation of the direction of drilling is required, the rotation of the drill string may be stopped and the bit may be positioned in the borehole, using the downhole motor, so that the drill bit in the required direction and rotation of the drill bit may start the drilling in the desired direction. In such an arrangement, the direction of drilling is dependent upon the angular position of the drill string.

In its idealized form, in a pointing the bit system, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953 all herein incorporated by reference.

Push the bit systems and methods make use of application of force against the borehole wall to bend the drill string and/or direct application of a side force on the drill bit to drill in a preferred direction. In a push-the-bit rotary steerable system, the requisite non-collinear condition is achieved by causing a mechanism to apply a force or create displacement in a direction that is preferentially orientated with respect to the direction of hole-propagation. There are many ways in which this may be achieved, including non-rotating (with respect to the hole) displacement based approaches and eccentric actuators that apply force to the drill bit in the desired steering direction. Again, steering is achieved by creating non co-linearity between the drill bit and at least two other touch points. In its idealized form the drill bit is required to cut sideways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; 5,971,085 all herein incorporated by reference.

Known forms of RSS may include a "counter rotating" mechanism, which rotates in the opposite direction of the drill string rotation. Typically, the counter rotation occurs at the same speed as the drill string rotation so that the counter rotating section maintains the same angular position relative to the inside of the borehole. Because the counter rotating section does not rotate with respect to the borehole, it is often called "geostationary" by those skilled in the art. In this disclosure, no distinction is made between the terms "counter rotating" and "geo-stationary."

A push-the-bit system typically uses either an internal or an external counter-rotation stabilizer. The counter-rotation stabilizer remains at a fixed angle (or geo-stationary) with respect to the borehole wall. When the borehole is to be deviated, an actuator that is held geostationary by the stabilizer may be actuated to press a pad against the borehole wall in the opposite direction from the desired deviation. The result is that a side force is applied to the drill bit that pushes the drill bit to cut in the desired direction.

The force generated by the actuators/pads is balanced by the force to bend the bottomhole assembly, and the force is reacted through the actuators/pads on the opposite side of the bottomhole assembly and the reaction force acts on the cutters of the drill bit, thus steering the hole. In some situations, the force from the pads/actuators may be large enough to erode the formation where the system is applied.

For example, the Schlumberger™ Powerdrive™ system uses three pads arranged around a section of the bottomhole assembly to be synchronously deployed from the bottomhole assembly to push the bit in a direction and steer the borehole being drilled. In the system, the pads are mounted close, in a range of 1-4 ft behind the bit and are powered/actuated by a stream of mud taken from the circulation fluid. In other systems, the weight-on-bit provided by the drilling system or a wedge or the like may be used to orient the drilling system in the borehole.

Another way to generate a side force on the drill bit is to use a drill bit with a cutter structure that is designed to generate a varying or relatively constant side force on the drill bit in a direction that remains broadly fixed in one direction relative to the body of the drill bit (or at least in one quadrant). This may be readily achieved by judicious arrangement of the cutters as is done in the case of the anti-whirl bit (where the mean cutting side force is directed towards a particular gauge pad which is thereby held, while rotating, against the bore wall). For directional drilling purposes, the off-center side force developed by the cutter arrangement may be used to drive a set of gauge cutters towards the borehole wall (the opposite of anti-whirl). As the bit rotates, so does the cutting side force and, therefore, the preferred cutting direction.

SUMMARY

This disclosure relates in general to a method and a system for controlling a rotary drilling system to directionally drill a borehole through an earth formation, the rotary drilling system comprising a drill string and a drill bit, wherein the drill bit is rotated by the drill string against the earth formation. More specifically, but not by way of limitation, embodiments of the present invention provide for controlling the motion of the drilling system in a borehole being drilled by the system and/or the reaction forces between the drilling system and a side-wall/inner-wall of the borehole when a side force is acting on the drilling system. In such embodiments, controlling the motion of the drilling system in the borehole and/or the reaction forces between the drilling system and the side-wall/inner-wall when a side force is acting on the drilling system may provide for directing the drilling system to drill the borehole in a desired direction and/or focusing or biasing the motion of the drill bit and/or direction of drilling of the drill bit produced by the side force.

In certain aspects, by controlling the motion of the drill bit in the borehole so that a desired motion remains in a constant direction while the drilling system rotates in the borehole, the rotary drilling system may drill the borehole in the desired direction, which direction, may in certain embodiments, be adjusted during the drilling process. In other aspects, an asymmetric gauge pad arrangement that rotates during the drilling process may provide for emphasizing/focusing side ways drilling of the drill bit under the side force.

In certain aspects of the present invention, side cutting of a sidewall of the borehole by the drill bit of the drilling system when a side force is applied may be controlled to provide for selectively directing the side cutting of the sidewall and, as a result, directional drilling of the borehole through the earth formation. In certain aspects a side-cutting-control-element is used to control the sideways drilling of the borehole by the drill bit, the side-cutting-control-element being coupled with the drilling system to provide that the side-cutting-control-element remains geostationary in the borehole during rotary drilling.

As such, in one embodiment of the present invention, a method for controlling a rotary drilling system, the rotary drilling system comprising a drill string and a bottom-hole assembly, the bottomhole assembly including a drill bit, to directionally drill a borehole through an earth formation, is provided, the method comprising: applying a side force to the bottomhole assembly to provide for side cutting by the drill bit; and controlling motion of the bottomhole assembly in the borehole, wherein the motion of the bottomhole assembly is controlled to provide for directing the side cutting.

In certain aspects, a geostationary control element may be used to control the motion of the bottomhole assembly in the borehole. The geostationary element may be configured to control interactions between the bottomhole assembly and a sidewall of the borehole to provide for biasing/focussing the motion of the borehole in a particular direction. In such aspects, because the control element is geostationary in the borehole, the control element may cause the drilling system to drill in a sideways direction even though the drilling system is rotating in the borehole.

In certain aspects, the geostationary control element may comprise a sleeve eccentrically coupled with the bottomhole assembly. In such aspects, when the side force is applied to the bottomhole assembly, the side force will drive the bottomhole in a direction essentially coincident with the side force. However, the eccentrically coupled sleeve may interact with the sidewall of the borehole and in inhibit motion of the bottomhole assembly in certain directions, while not inhibiting or inhibiting by a reduced amount the motion of the bottomhole assembly in other directions. As such, in an embodiment of the present invention, when the eccentrically coupled sleeve repeatedly interacts with the sidewall under as the side force acts on the bottomhole assembly, the eccentrically coupled sleeve may direct/focus/bias the motion of the bottomhole assembly and cause the drill bit to sideways cut the borehole in the directed/focussed/biased direction.

In certain aspects of the present invention, the drill bit of the drilling system may comprise a uniform distribution of gauge cutters. As such, when the side force is applied to the drill bit the gauge cutters are driven into engagement with the sidewall of the borehole in a direction coincident with the direction of the side force. However, during motion of the bottomhole assembly in the borehole when the said force acts on the bottomhole assembly, certain sections of the eccentrically coupled sleeve may inhibit engagement of the gauge cutters with the sidewall where the sections of the sleeve extend beyond or up to the gauge of the gauge cutters and these sections of the sleeve will come into contact with the side-and prevent the gauge cutters fully engaging with the sidewall. By contrast, other sections of the eccentrically coupled sleeve may not interfere with the engagement of the gauge cutters with the sidewall and may allow the gauge cutters to fully engage with the sidewall when contacting the sidewall under motion of the bottomhole assembly resulting from the acting side force. As such, the eccentrically coupled sleeve may control the side cutting of the borehole by the gauge cutters under the applied side force.

The sleeve may comprise a disc, a cylinder or the like coupled with the drill bit and/or the bottomhole assembly. The sleeve may comprise a drill collar, a gauge pad or the like. In certain aspects, the sleeve may comprise a plurality of separate elements arranged around the bottomhole assembly and arranged so as to provide that an outer-surface of the bottomhole assembly and the plurality of elements is asymmetric. In other aspects, an extendable element coupled with the bottomhole assembly and extended from the bottomhole assembly to provide that interactions between the bottomhole assembly and the sidewall are not uniform.

In certain aspects, the sleeve may be rotatably coupled with the bottomhole assembly. In such aspects, the sleeve may be rotated on the bottomhole assembly so that the section of the sidewall that is fully engaged with or engaged with lesser inhibition by the gauge cutters may be changed according to the sleeves position. In this way, the cutting of the sidewall by the gauge cutters under the side force may be directed/focussed in a desired direction by rotating the eccentrically coupled sleeve on the bottomhole assembly as desired.

In certain aspects, instead of a sleeve a plurality of gauge pads may be coupled with the bottomhole assembly to provide that an outer surface formed by the outer surfaces of the gauge pads is asymmetric. This asymmetric surface will control the motion of the bottomhole assembly in the borehole as the bottomhole assembly repeatedly interacts with the sidewall of the borehole as the side force acts on the bottomhole assembly. As with an eccentrically coupled sleeve, the asymmetric outer surface may be used to direct/bias/focus the motion of the borehole, which directed motion may, in turn, cause the drill bit to sideways cut the borehole in alignment with the directed/focussed/biased motion.

In certain aspects of the present invention, the drill bit of the rotary drilling system may comprise one or more gauge cutters for engaging with and cutting into the sidewall. In such aspects, the asymmetric gauge pads may be configured to provide for the directional drilling of the borehole by inhibiting interaction between the one or more gauge cutters and the sidewall over a range of azimuthal angles and not inhibiting interaction between one or more gauge cutters and the sidewall over a complementary range of azimuthal angles.

In some embodiments of the present invention, directional control element of the system may comprise a cylinder, a disc or a plurality of elements coupled with the drill bit and/or the bottomhole assembly wherein the cylinder, the disc or the plurality of elements has a compliance that varies circumferentially. As such, when a section of the cylinder or disc or one of the plurality of elements having a low compliance/elasticity contacts the sidewall under the action of the side force, the section may resist movement in that direction of motion, whereas a more compliant/elastic section of the cylinder or disc or a more elastic/compliant element may deform/comply and allow motion and/or resist the motion to a lesser extent in the direction of the more compliant/elastic section. Consequently, repeated interactions between the cylinder, disc or the plurality of elements and the sidewall will cause the direction of motion of the bottomhole assembly in the borehole under the influence of the side-force to be directed and, as a result, the side cutting by the drill bit to be directed.

In certain aspects of the present invention, the drill bit of the rotary drilling system may comprise one or more gauge cutters for engaging with and cutting into the sidewall. In such aspects, when a section of the cylinder or disc or one of the plurality of elements having a low compliance/elasticity contacts the sidewall under the side force it may resist engagement between a gauge cutter and the sidewall of a gauge cuter located proximal to the section of the cylinder or disc or one of the plurality of elements having a low compliance/elasticity. In contrast, a more compliant/elastic section of the cylinder or disc or a more elastic/compliant element will deform/comply under the side force upon contact with the sidewall allowing greater engagement between a gauge cutter proximal to the more elastic/compliant element or section and the sidewall. As a result, there will be an increased cutting of the sidewall in the direction of the compliant section/element compared to the cutting of the sidewall in the direction of a section or element with lesser elasticity/compliance and directional drilling of the borehole.

The side force of the present invention may be generated by any known method. These methods may include, but are not limited to, arranging cutters on the drill bit so as to develop a side force acting on the drill bit when the drill bit drills the borehole, using a flexible member and/or a bent sub and a plurality of stabilizers to use the weight-on-bit to generate the side force, manipulating the drill bit to point in a direction away from a central axis of the borehole, using an actuator coupled with the bottomhole assembly to apply a force against an inner-wall of the borehole and/or the like.

In another embodiment of the present invention, an apparatus for controlling a rotary drilling system to directionally drill a borehole through an earth formation, may comprise: a bottomhole assembly, the bottomhole assembly including a drill bit; and a directional control element coupled with the bottomhole assembly and configured to generate motion of the bottomhole assembly in a selected direction when a side force is applied to the bottomhole assembly. In some embodiments, the control element is coupled with the bottomhole assembly such that the control element remains geostationary in the borehole during a rotary drilling process.

In one embodiment of the present invention, an apparatus for controlling a rotary drilling system to directionally drill a borehole through an earth formation, comprises: a drill bit; one or more gauge cutters coupled with the drill bit and configured to engage a sidewall of the borehole; and a directional control element coupled with the drill bit so as to remain geostationary during rotary drilling of the borehole and configured to allow for cutting of the sidewall by the one or more gauge cutters over a desired range of azimuthal angles and to inhibit cutting of the sidewall by the one or more gauge cutters over a complementary range of azimuthal angles.

In one embodiment of the present invention, a geostationary eccentric gauge assembly may be used with a drill bit that has a side force applied to the drill bit in a direction that remains broadly fixed in one direction relative to the body of the bit (or at least in one quadrant). This side force may be a push the bit type side force, a point the bit type side force, generated by judicious arrangement of the cutters on the bit and/or the like. In the system, the mean cutting side force of the drill bit is directed towards a particular direction (quadrant). In the embodiment, the geocentric gauge assembly may be held geostationary and may be used to modulate the cutting of the bit yielding a preferred cutting direction relative to the earth and thereby provides a controllable mechanism for rotary steering. The eccentric sleeve of the embodiment is configured so as to inhibit the interaction of gauge cutters with the formation over a range of azimuthal directions while allowing the gauge cutters to engage with the bore wall over the complementary range of azimuthal directions. In this way the bit is prevented from cutting sideways over the inhibited range, while free to cut sideways over the complementary range. By controlling the orientation of the geostationary sleeve the directional tendency of the bit is controlled while rotating the drilling assembly.

Some embodiments provide a rotary drilling system, a device/method for generating a side force on the bottomhole assembly and/or the drill bit of the drilling system and a control element for biasing the side force generated/acting on the bottomhole assembly and/or the drill bit.

Aspects provide for controlling a rotary drilling system to directionally drill a borehole through an earth formation. As such, control elements for controlling interactions between the bottomhole assembly and/or the drill bit and the inner-wall of the borehole being drilled and/or biasing a side force acting on the bottomhole assembly and/or the drill bit may be active/moveable so as to selectively change a direction of drilling, may be geostationary to provide directional drilling in a fixed direction, may be configured to bias an applied/generated side force, where characteristics of the applied/generated side force may be considered in the configuration. Further, the control element may be configured to take into account characteristics of a non-applied/non-generated side force, such as gravity.

In a further embodiment, an apparatus for controlling a rotary drilling system to directionally drill a borehole through an earth formation is provided, the apparatus comprising: a drill bit; means for generating a side force to act on the drill bit; and means for biasing the generated side force. In certain aspects, the means for biasing the generated side force may comprises one or more gauge pads, wherein the gauge pads are coupled with the drill bit to provide that a gauge of the drill bit and the coupled gauge pads is non-uniform. The gauge pads may rotate during the drilling process and may serve to emphasize/focus sideways drilling of the borehole under an applied side force.

In some embodiments, the means for biasing the generated side force may comprise a set of gauge pads coupled with the drill bit, wherein the set of gauge pads may comprise a plurality of gauge pads that are coupled with the drill bit to provide that a circumference formed by each borehole inner-wall-facing-surface of the plurality of the gauge pads is asymmetric with regard to a longitudinal axis of the drill bit, the inner-wall-facing-surface being the surface of the gauge pad that faces the inner-wall of the borehole during a drilling procedure. In certain aspects, the gauge pad(s) may comprises one or more gauge cutters. A controller capable of controlling at least one of the means for generating a side force and the means for biasing the generated side force may be used to control the directional drilling by the drilling system

BRIEF DESCRIPTION OF THE DRAWINGS

In the figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

The invention will be better understood in the light of the following description of non-limiting and illustrative embodiments, given with reference to the accompanying drawings, in which.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. Various changes may be made in the function and arrangement of elements of the specification without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, systems, structures, and other components may be shown as components in block diagram form in order not to obscure the embodiments in unnecessary detail. In other instances, well-known processes, techniques, and other methods may be shown without unnecessary detail in order to avoid obscuring the embodiments.

Also, it is noted that individual embodiments may be described as a process which is depicted as a flowchart, a flow diagram, a structure diagram, or a block diagram. Although a flowchart may describe the operations as a sequential process, many of the operations can be performed in parallel or concurrently. In addition, the order of the operations may be re-arranged. Furthermore, any one or more operations may not occur in some embodiments. A process is terminated when its operations are completed, but could have additional steps not included in a figure. A process may correspond to a method, a procedure, etc.

This disclosure relates in general to a method and a system for controlling a directional drilling system to directionally drill a borehole through an earth formation. More specifically, but not by way of limitation, embodiments of the present invention provide controlling motion of a bottomhole assembly and/or a drill bit in the borehole under application of a side force to control the bottomhole assembly and/or a drill bit to drill the borehole in the desired direction through the earth formation.

Figure 1A:
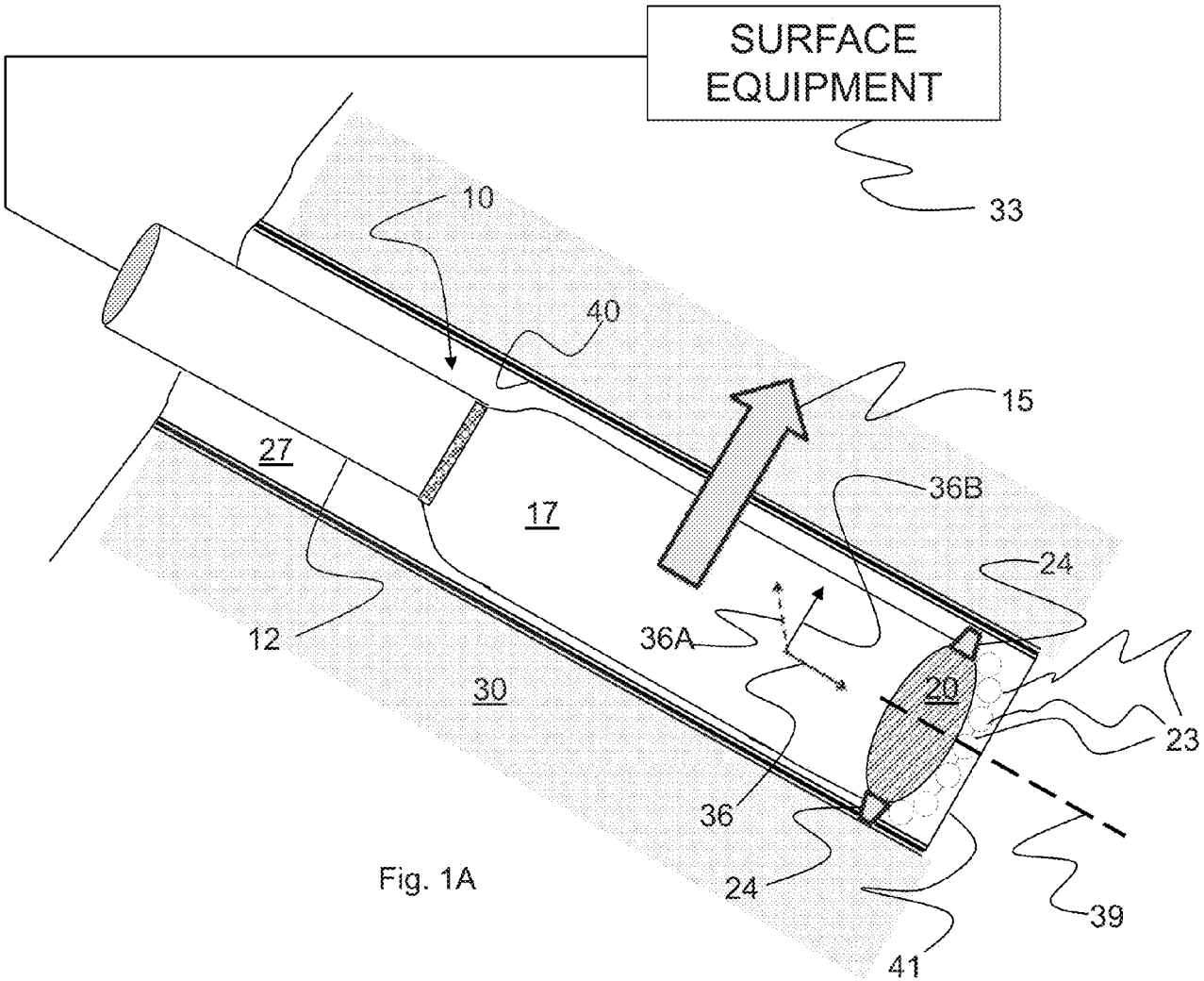
FIG. 1A is a schematic-type illustration of a directional drilling system.

FIG. 1 is a schematic-type illustration of a rotary drilling system for drilling a borehole. As depicted in FIG. 1, a drill string 10 may comprise a connector system 12 and a bottomhole assembly 17 and may be disposed in a borehole 27; where the borehole 27 is being drilled by the rotary drilling system. The bottomhole assembly 17 may comprise a drill bit 20 along with various other components (not shown), such as a bit sub, a mud motor, stabilizers, drill collars, heavy-weight drillpipe, jarring devices ("jars"), crossovers for various thread forms and/or the like. The bottomhole assembly 17 may provide force for the drill bit 20 to break the rock—which force may be provided by weight-on-bit or the like—and the bottomhole assembly 17 may be configured to survive a hostile mechanical environment of high temperatures, high pressures and/or corrosive chemicals. The bottomhole assembly 17 may include a mud motor, directional drilling and measuring equipment, measurements-while-drilling tools, logging-while-drilling tools and/or other specialized devices.

A drill collar or the like may be coupled with the bottomhole assembly 17 and may comprise a heavy component that may be used to provide weight-on-bit to "push" the drill bit into contact with a drilling face. As such, the drill collars may comprise a thick-walled, heavy, tubular component that may have a hollowed out centre to provide for the passage of drilling fluids through the collar. The outside diameter of the collar may be rounded so as to pass through the borehole 27 being drilled, and in some cases may be machined with helical grooves ("spiral collars"). The drill collar may comprise threaded connections, male on one end and female on the other, so that multiple collars may be screwed together along with other downhole tools that collectively may comprise the bottomhole assembly 17.

In a rotary drilling system, a motor at the surface may be used to rotate the connector system 12 causing the drill bit 20 to rotate on the bottom of the borehole 27. In some systems, surface equipment 33 may comprise a topdrive, rotary table or the like (not shown) that may transfer rotational motion via the connector system 12, which may comprise drill pipe, casing, coiled tubing or the like—to the drill bit 20. In some systems, the topdrive may consist of one or more motors—electric, hydraulic and/or the like—that may be connected by appropriate gearing to a short section of pipe called a quill. The quill may in turn be screwed into a saver sub or the drill string, casing or coiled tubing itself. The topdrive may be suspended from a hook so that it is free to travel up and down a derrick. Pipe, coiled tubing or the like may be attached to the topdrive, rotary table or the like to transfer rotary motion down the borehole 27 to the drill bit 20.

In a rotary drilling system, gravity acts on the bottomhole assembly 17, which may comprise the large mass of the drill collar(s)—providing a downward force that may cause the drill bit 20 to break rock and drill through the earth formation as it is rotated. To accurately control the amount of force applied to the drill bit 20, a driller may carefully monitor the surface weight of the drilling system, measured while the drill bit 20 is just off a bottom surface 41 of the borehole 27. Next, the drill string (and the drill bit), may be slowly and carefully lowered until it touches the bottom surface 41 of the borehole 27. After that point, as the driller continues to lower the drill string, more weight is applied to the drill bit 20, and correspondingly less weight is measured as hanging at the surface. Merely by way of example, when the surface measurement shows 20,000 pounds [9080 kg] less weight than with the drill bit 20 off the bottom surface 41, then there should be 20,000 pounds force on the drill bit 20 (in a vertical hole). Downhole sensors may be used to measure weight-on-bit more accurately and transmit the data to the surface.

The drill bit 20 may comprise one or more cutters 23. In operation, the drill bit 20 may be used to crush and/or cut rock at the bottom surface 41 so as to drill the borehole 27 through an earth formation 30. The drill bit 20 may be disposed on the bottom of the connector system 12 and the drill bit 20 may be changed when the drill bit 20 becomes dull or becomes incapable of making progress through the earth formation 30. The drill bit 20 and the cutters 23 may be configured in different patterns to provide for different interactions with the earth formation and generation of different cutting patterns.

A conventional drill bit 20 operates by boring a hole slightly larger than the maximum outside diameter of the drill bit 20, where the diameter/gauge of the borehole 27 results from the reach of the cutters of the drill bit 20 and the interaction of the cutters with the rock being drilled. This drilling of the borehole 27 by the drill bit 20 is achieved through a combination of the cutting action of the rotating drill bit 20 and the weight on the bit created, the weight on the drill bit being a result of the mass of the drill string. Generally, the drilling system may include a gauge pad(s), which may extend outward to the gauge of the borehole 27. The gauge pads may comprise pads disposed on the bottomhole assembly 17 or pads on the ends of some of the cutters of the drill bit 20 and/or the like. The gauge pads may be used to stabilize the drill bit 20 in the borehole 27 to provide for uniform drilling of the borehole.

The drill bit 20 may comprise one or more gauge cutters 24, the gauge cutters 24 may be disposed around the periphery of the drill bit, coupled with the gauge pads or the like and may be configured to engage a sidewall 40 of the borehole 27. In operation, the gauge cutters 24 may engage the sidewall 40 to provide that the rotary drilling system drills out a borehole with a gauge equal to or slightly greater than the diameter of the drill bit 20.

The connector system 12 may comprise pipe(s)—such as drillpipe, casing or the like—coiled tubing and/or the like. The pipe, coiled tubing or the like of the connector system 12 may be used to connect surface equipment 33 with the bottomhole assembly 17 and the drill bit 20. The pipe, coiled tubing or the like may serve to pump drilling fluid to the drill bit 20 and to raise, lower and/or rotate the bottomhole assembly 17 and/or the drill bit 20.

In some drilling systems, drilling motors (not shown) may be disposed down the borehole 27. The drilling motors may comprise electric motors hydraulic-type motors and/or the like. The hydraulic-type motors may be driven by drilling fluids or other fluids pumped into the borehole 27 and/or circulated down the drill string. The drilling motors may be used to power/rotate the drill bit 20 on the bottom surface 41. Use of drilling motors may provide for drilling the borehole 27 by rotating the drill bit 20 without rotating the connector system 12, which may be held stationary during the drilling process.

The rotary motion of the drill bit 20 in the borehole 27, produced by a rotating drill pipe and/or a drilling motor, may provide for the crushing and/or scraping of rock at the bottom surface 41 to drill a new section of the borehole 27 in the earth formation 30. The rotating of the gauge cutters 24 against the sidewall 40 may provide for drilling a small layer of the sidewall 40 around the drill bit 20. Drilling fluids may be pumped down the borehole 27, through the connector system 12 or the like, to provide energy to the drill bit 20 to rotate the drill bit 20 or the like to provide for drilling the borehole 27, for removing cuttings from the bottom surface 41 and/or the like.

In some drilling systems, hammer bits may be used pound the rock vertically in much the same fashion as a construction site, air hammer. In other drilling systems, downhole motors may be used to operate the drill bit 20 or an associated drill bit or to provide energy to the drill bit 20 in addition to the energy provided by the topdrive, rotating table, drilling fluid and/or the like. Further, fluid jets, electrical pulses and/or the like may also be used for drilling the borehole 27 or in combination with the drill bit 17 to drill the borehole 27.

During a drilling operation, forces which may act on the drill bit 20 may include gravity, torque developed by the drill bit 20, the end load applied to the drill bit 20, the bending moment from the drilling system including the connector system 12 and/or the like. These forces together with the type of formation being drilled and the inclination of the drill bit 20 to the face of the bottom surface 41 of the borehole 27 may create a complex interactive system of applied and reactionary forces. In a rotary drilling system, the drilling system when drilling vertically will, in general, absent application of a directional force on the drill bit, drill a vertical borehole. For non-vertical drilling, the rotary drilling system will drill in a generally continuous forward direction; however, the gravitational force forward will cause the drill bit to tend to drill towards the vertical.

To provide for directional drilling by a rotary drilling system, a side force 15 may be applied to the drill bit 20. Application of the side force 15 to the drill bit 20 drives the drill bit 20 to cut sideways, i.e., away from a central axis 39 of the borehole 27. By maintaining the side force 15 in a particular direction in the borehole 27, the drill bit 20 will be driven to continuously drill, at least in part, in the direction of the applied side force resulting in a section of borehole being directionally drilled (in contrast to a section of borehole drilled simply by the weight on the bit and the rotation of the drill bit against the face of the borehole).

When the side force 15 is applied to the bottomhole assembly 17 and/or the drill bit 20, the side force 15 may cause the gauge cutters 24 to engage with the sidewall 40 and this may cause the gauge cutters 24 to preferentially drill/remove pieces of formation from the sidewall 40 in a direction coincident with the applied side force 15 so providing for and/or aiding the sideways cutting of the borehole 27 in the direction of the applied side force. By controlling the side force 15, the rate of drilling, the weight-on-bit and/or the like, the drill bit 20 may drill in a desired trajectory through the earth formation 30.

Various systems have sought to provide for directional drilling by a rotary drilling system by controlling the existing forces being applied to the drill bit 20 during the rotary drilling or applying new forces to the drill bit 20. These systems have sought to bend/shape/direct/push the drilling system so as to orient the drilling system in the borehole and/or relative to the bottom of the borehole 27 so that the motion of the drill bit 20 is directed at least in part sideways, i.e., away from the central axis 39. Some of the systems may use/harness the large gravitational forces acting on the drilling system and/or may provide for generating large reaction forces on the drilling system by thrusting outward from the bottomhole assembly into the earth formation 30 to orient the drilling system in the borehole and/or relative to the bottom of the borehole 27 and/or to push the drill bit 20 so as to steer the drilling system to directionally drill the borehole 27. Other systems may bend the drilling system or use bent portions in the drilling system to direct the drill bit to drill sideways, off center.

In certain drilling processes, a bent pipe (not shown), known as a bent sub, or an inclination/hinge type mechanism may be disposed between the drill bit 20 and the drilling motor. The bent sub or the like may be positioned in the borehole to provide that the drill bit 20 meets the face of the bottom surface 41 in such a manner as to provide for drilling of the borehole 27 in a particular direction, angle, trajectory and/or the like. The position of the bent sub may be adjusted in the borehole without a need to remove the connector system 12 and/or the bottomhole assembly 17 from the borehole 27. However, directional drilling with a bent sub or the like may be complex because forces in the borehole during the drilling process may make the bent sub difficult to manoeuvre and/or to effectively use to steer the drilling system.

When drilling straight with a conventional drilling system, with or without the application of the side force 15, Applicants have determined that the drill bit 20 may, essentially, "vibrate" in the borehole 27, with the vibrations comprising repeated movement/stochastic motion of the drill bit 20 in radial directions, i.e., outward from the central axis 39. The terms vibration/oscillation/stochastic motion are used herein to describe repeated/continuous movements of the drilling system during the drilling process that may be in a direction in the borehole other than the drilling direction and whose direction and periodicity may be somewhat random in nature.

These vibrations/oscillations of the drilling system may be limited by the effects of the cutters impacting and extending the surface of the hole and by the gauge pads or the like hitting the wall of the borehole 27. In tests, Applicants found that drilling systems comprising drill bits without gauge pads produce a borehole with a diameter that was significantly larger than equivalent drilling systems comprising drill bits and gauge pads. Analyzing results from these tests, it was determined that during operation of the drilling system, the bottomhole assembly 17 repeatedly undergoes a motion that involves movements away from the central axis 39 of the bottomhole assembly 17 and/or the drill bit 20, i.e. in a radial direction towards an inner-wall 40 of the borehole 27, during the drilling process. Analysis of various drilling operations found that the gauge pads confine this radial motion of the bottomhole assembly 17 and/or the drill bit 20 to produce a borehole with a smaller bore. The gauge pads of conventional drilling systems being deployed to minimize/eliminate the vibrational motion of the drilling system to provide a smaller/regular bore.

From experimentation and analysis of drilling systems, Applicants found that when the drill bit 20 drills into the earth formation 30 the cutters 23 may not uniformly interact with the earth formation, for example chips may be generated from the earth formation 30, and, as a results, an unsteady motion/stochastic motion, being a motion in a direction other than a longitudinal/forward motion of the bottomhole assembly 17 and/or the drill bit 20, may be generated in the bottomhole assembly 17 and/or the drill bit 20. Applicants have analyzed the operation of the drilling system and found that during operation of the drilling system—the application of force through the connector system 12 and the drill bit 20 on to the earth formation 30 at the bottom of the borehole 27, the operation/rotation of the drill bit 20, the interaction of the drill bit 20 with the earth formation 30 at the bottom of the borehole 27 (wherein the drill bit 20 may slip, stall, be knocked off of a drilling axis and/or the like), the rotational motion of the connector system 12, the operation of the topdrive, the operation of the rotational table, the operation of downhole motors, the operation of drilling aids such as fluid jets or electro-pulse systems, the bore of the borehole 20 (which may be irregular) and/or the like—may generate motion in the bottomhole assembly 17 and/or the drill bit 20, and this motion may be a repeated, random, transient, stochastic motion, wherein at least a component of the stochastic motion is not directed along an axis of the bottomhole assembly 17 and/or the drill bit 20 and is instead directed radially outward from a longitudinal-type axis at a centre of the bottomhole assembly 17 and/or the drill bit 20.

Furthermore, Applicants have found that the unsteady/stochastic motion of the drill bit 20 and/or the bottomhole assembly 17 may also occur when the side force 15 is applied to the drill bit 20 and/or the bottomhole assembly 17. As such, during directional drilling of a borehole, when the side force 15 is applied to the drill bit 20 and/or the bottomhole assembly 17, the drill bit 20 and/or the bottomhole assembly 17 undergo stochastic motion and do not interact uniformly with the sidewall 40. As noted above, the motion of the drill bit 20 and/or the bottomhole assembly 17 is complex because of factors such as the non-uniform properties of the earth formation 30, the various different forces acting on the drill bit 20 and/or the bottomhole assembly 17 and/or the like. Consequently, even when the side force 15 is applied in a uniform manner, which is extremely difficult to provide for in practice, the drill bit 20 and/or the bottomhole assembly 17 may be driven into a motion by the side force 15 that is not coincident with the side force 15, but may instead comprise a motion that is a combination of a motion generated by the side force 15 in the direction of the side force 15 and the stochastic motion of the drill bit 20 and/or the bottomhole assembly 17. In reality, the side force 15, because of how it is generated—such as by repeated application of a force against the sidewall 40 by an actuator or the like, by drill cutter arrangement, by bending the drill string, by using a bent sub and/or the like—is not uniform and may over time be directed in a range of azimuthal angles and, as a result, may cause the drill bit 20 and/or the bottomhole assembly 17 to undergo motion in the borehole 27 in radial directions corresponding to the range of azimuthal angles.

As such, during a directional drilling operation, the kinetics of the bottomhole assembly 17 may comprise both a longitudinal motion 37 in the drilling direction as well as transient, radial motions 36A and 36 B, wherein the transient radial motions 36A and 36 B may comprise any motion of the bottomhole assembly 17 directed away from a central axis 39 of the borehole 27 being drilled and/or a central axis of the bottomhole assembly 17 and/or the drill bit 20. And these transient, radial motions may not be coincident with the direction of the side force 15 and/or the side force 15 may not be unidirectional and may itself cause transient, radial motion of the bottomhole assembly 17 over a range of azimuthal angles.

In general, it has been determined that the radial motion of the bottomhole assembly 17 during the drilling process may be random, transient in nature. As such, the bottomhole assembly 17 may undergo repeated random radial/unsteady motion throughout a directional drilling process. For purposes of this specification, the repeated radial/unsteady motion of the bottomhole assembly 17 in the borehole 27 during the drilling process may be referred to as a dynamic motion, a radial motion, stochastic motion, an unsteady motion, a radial-dynamic motion, a radial-unsteady motion, a dynamic or unsteady motion of the bottomhole assembly 17 and/or the drill string, a repeated radial motion, a repeated dynamic motion, a repeated unsteady motion, a vibration, a vibrational-type motion and/or the like.

The dynamic and/or unsteady motion of the bottomhole assembly 17 during the drilling of the borehole 27 may cause/result in the bottomhole assembly 17 repeatedly coming into contact with and/or impacting an inner surface of the borehole 27 throughout the drilling process. The inner surface of the borehole 27 comprising the inner-wall 40 and the bottom surface 41 of the borehole 27, i.e. the entire surface of the earth formation 30 that defines the borehole 27. As discussed previously, the dynamic and/or unsteady motion of the bottomhole assembly 17 may be random in nature and, as such, may cause/result in random intermittent/repeated contact and/or impact between the bottomhole assembly 17 and the inner surface during the drilling process.

The intermittent/repeated contact and/or impact between the bottomhole assembly 17 and the inner surface during the drilling process resulting from dynamic and/or unsteady motion of the bottomhole assembly 17 may occur between one or more sections/components of the bottomhole assembly 17 and the inner surface. For example, the sections/components may be a section of the bottomhole assembly 17 proximal to the drill bit 20, a component of the bottomhole assemble 17, such as for example a drill collar, gauge pads, stabilizers, a motor housing, a section of the connector system 12 and/or the like. For purposes of this specification, the interactions between the bottomhole assembly 17 and the inner surface caused by/resulting from the dynamic and/or unsteady of the bottomhole assembly 17 may be referred to as dynamic interactions, unsteady interactions, radial motion interactions, vibrational interactions and/or the like.

Figure 1B:
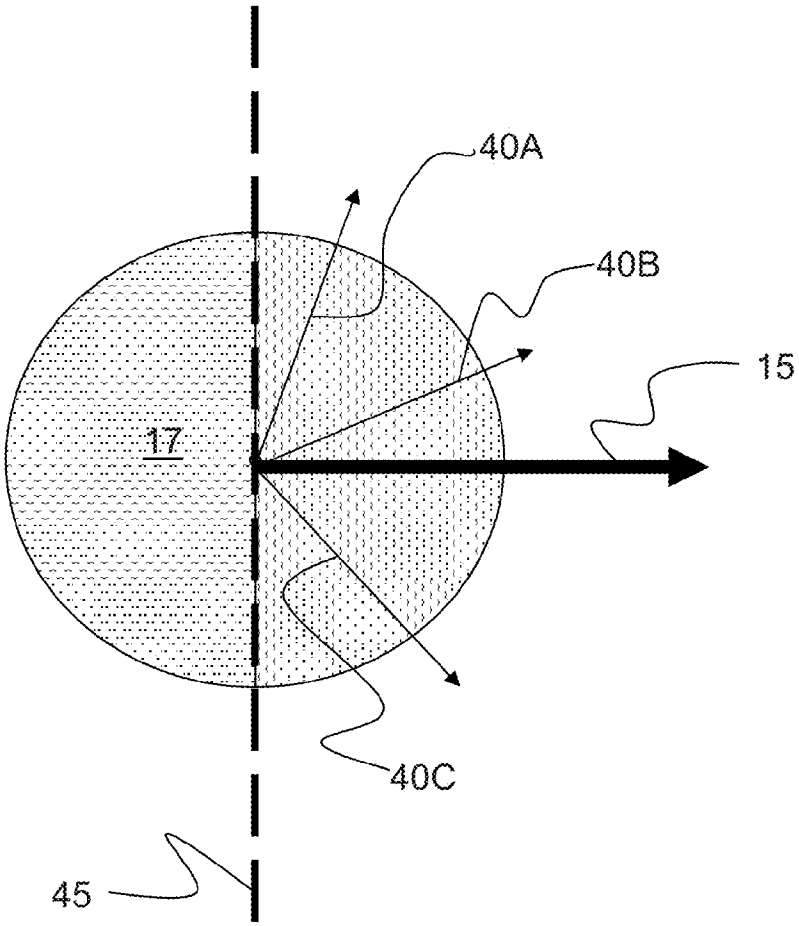
FIG. 1B illustrates motion of a bottomhole assembly and/or a drill bit of the directional drilling system of FIG. 1A in the borehole being drilled when a side force is applied to the bottomhole assembly and/or the drill bit during a directional drilling process.

FIG. 1B is a cross-section through the bottomhole assembly 17 illustrating the lateral motion of the bottomhole assembly 17 in the borehole under a side-force. As described above, the bottomhole assembly 17 undergoes a stochastic motion in the borehole during a directional drilling process. As such, and because a side force cannot in general be applied to the bottomhole assembly 17 that is unidirectional, when the side force 15 is applied to the bottomhole assembly 17, the motion of the bottomhole assembly 17 may be directed over a range of azimuthal angles 40A, 40B and 40C in addition to motion coincident with the direction of the side force 15, where the range of the azimuthal angles may in general mainly lie within a hemisphere with a base 45, the base 45 being perpendicular to the side force 15.

Figures 2A, 2B:
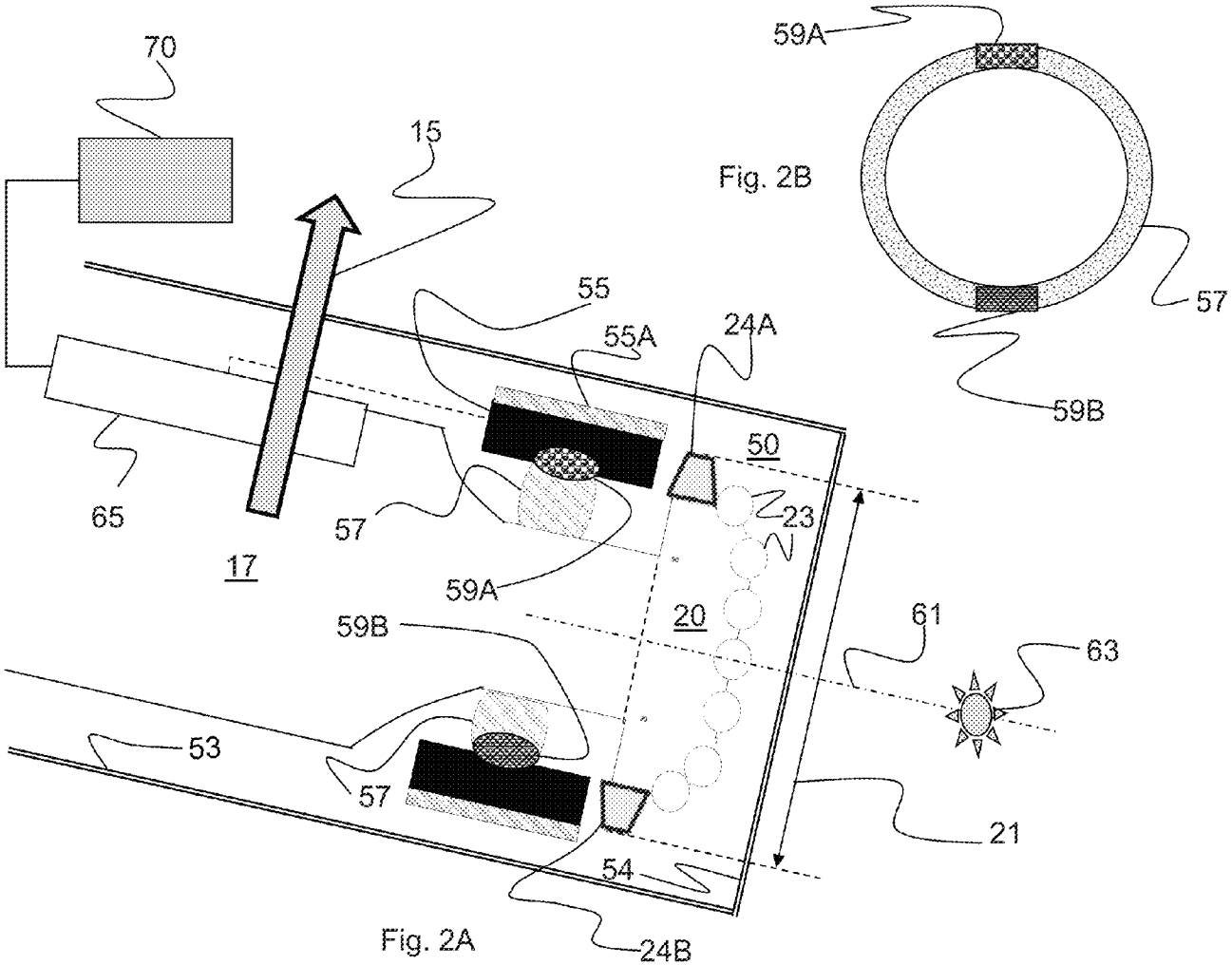
FIG. 2A is a schematic-type illustration of a system for controlling directional drilling by a directional drilling system, in accordance with an embodiment of the present invention.
FIG. 2B is a cross-sectional view through a compliant system for use in the system for controlling directional drilling of FIG. 2A, in accordance with an embodiment of the present invention.

FIG. 2A is a schematic-type illustration of a system for controlling a side force to steer a drilling system to directionally drill a borehole, in accordance with an embodiment of the present invention. In FIG. 2A, the drilling system for drilling the borehole may comprise the bottomhole assembly 17, which may in-turn comprise the drill bit 20. The drilling system may provide for drilling a borehole 50 having a sidewall 53 and a drilling-face 54.

During the drilling process, the drill bit 20 may contact the drilling-face 54 and crush/displace rock at the drilling-face 54. In an embodiment of the present invention, a collar assembly 55 may be coupled with the bottomhole assembly 17 by a compliant element 57. The collar assembly 55 may be a tube, cylinder, framework or the like. The collar assembly 55 may have an outer-surface 55A.

In certain aspects where the collar assembly 55 comprises a tube, cylinder and/or the like, the outer-surface 55A may comprise the outer-surface of the tube/cylinder and/or any pads, projections and/or the like coupled with the outer surface of the tube/cylinder. The collar assembly 55 may have roughened sections, coatings, projections on the outer surface 55A to provide for increased frictional contact between the outer-surface 55A of the collar assembly 55 and the sidewall 53. The collar assembly 55 may comprise a plurality of pads configured for contacting the sidewall 53.

In certain aspects, the collar assembly 55 may comprise a gauge pad system. In aspects where the collar assembly 55 may comprise a series of elements, such as pads or the like, the outer-surface 55A may be defined by the outer-surfaces of each of the elements (pads) of the collar assembly 55.

The drill bit 20 of the illustrated drilling system comprises the gauge cutters 24. The gauge cutters 24 may interact with and cut into the sidewall 53 during a drilling process. The side force 15 may be used to cause the drill bit 20 to move in a range of azimuthal directions that are generally centered on a direction coincident with the side force 15. As such, the gauge cutters 24 may tend to directionally drill into the sidewall 53. However, as noted previously, the engagement of the gauge cutters 24 with sidewall 53 may comprise somewhat sporadic interactions where the direction of sidewall drilling is not uniform, but may take place over a range of azimuthal directions.

In an embodiment of the invention, the collar assembly 55 may be configured with the bottomhole assembly 17 to provide that the outer-surface 55A engages, contacts, interacts and/or the like with the sidewall 53 and/or the drilling-face 54 during the drilling process as a result of the dynamic motion of the bottomhole assembly 17. The design/profile/compliance of the outer-surface 55A and/or the disposition of the outer-surface 55A relative to a cutting silhouette of the drill bit 20 may provide for controlling the interactions between the gauge cutters 24 and the sidewall 53 and the other cutters of the drill bit 20 and the drilling face 54.

The compliant element 57 may comprise a structure that provides a lateral movement of the collar assembly 55 relative to the drill bit 20, where the lateral movement is a movement that is, at least in part directed, towards a centre axis 61 of the bottomhole assembly 17. In certain aspects, the collar assembly 55 may itself be configured to be laterally compliant and may be coupled to the bottomhole assembly 17 and/or may be a section of the bottomhole assembly 17, without the use of the compliant element 57.

In one embodiment of the present invention, the compliant element 57 may not be uniformly-circumferentially compliant. In such an embodiment, one or more sections of the compliant element 57 disposed around the circumference of the compliant element 57 may be more laterally compliant than other sections of the compliant element 57.

As observed previously, during a directional drilling process, under the application of the side force 15, the cutters of the drill bit 20 may be driven by the side force 15 to drill away from the centre axis 61 and/or the gauge cutters 24A and 24B may undergo continuous and/or repeated interactions with the sidewall 53, wherein such interactions are biased in the general direction of the side force 15 since this side force 15 is applied to the bottomhole assembly 17 so as to generate motion of the bottomhole assembly 17 in the direction of the side force 15.

In an embodiment of the present invention, the lateral compliance of the compliant element 57 may vary circumferentially around the compliant element 57. As a result, the interaction between the collar assembly 55 and the sidewall 53 will not be uniform circumferentially around the collar assembly 55. Merely by way of example, the compliant element 57 may comprise an area of decreased compliance 59B and an area of increased compliance 59A.

In certain aspects, interactions between the collar assembly 55 and the sidewall 53 above a section of the compliant element 57 having increased lateral compliance, i.e., the area of increased compliance 59A, may provide for increased movement of the bottomhole assembly 17 in the direction of the area of increased compliance 59A in comparison with interactions between the collar assembly 55 and the sidewall 53 and/or the drilling-face 54 above a section of the compliant element 57 having decreased lateral compliance, i.e., the area of decreased compliance 59B. As such, a motion of the bottomhole assembly 17 in the direction of the area of increased compliance 59A is freer, greater than a motion of the bottomhole assembly 17 in the direction of the area of decreased compliance 59B, where the area of decreased compliance 59B when it contacts the sidewall 53 resists prevents motion of the bottomhole assembly 17 unlike the area of increased compliance 59A which yields under contact with the sidewall 53 allowing motion by the bottomhole assembly 17.

As a result of the non-uniformity of interactions between the collar assembly 55 and the sidewall 53, the motion of the bottomhole assembly 17 under the side force 15 may be biased, focused and/or directed. For example, motion of the bottomhole assembly 17 when the side force 15 is applied that is directed towards the area of decreased compliance 59B will be resisted when the collar assembly 55 interacts with the sidewall 53 in turn causing resistance of any side cutting by the drill bit 20 in that direction. In contrast, motion of the borehole assembly 17 under the side force 15 in a direction of an area of increased compliance 59A will at least partially be allowed by the compliance of the area of increased compliance 59A providing for more side drilling by the drill bit 20 in this direction. Consequently, the collar assembly 55, because of the non-uniform compliance, may bias, focus, direct the motion of the borehole assembly 17 under the applied force and, as a result may bias, focus direct the side cutting of the borehole by the drill bit 17 under the side force 15.

In a drilling system where the drill bit comprises the gauge cutter 24A and 24B, the gauge cutter 24A, being appurtenant to the area of increased compliance 59A, will engage with, have greater interaction with, the sidewall 53 when the side force 15 is directed in the direction of the area of increased compliance 59A then will be experienced by the gauge cutter 24B will when the side force 15 is directed in the direction of the area decreased compliance 59B. Consequently, the compliant element 57 may be used to bias/focus the side force 15 so that the gauge cutters 24 preferentially drill into the sidewall 53 in the direction of the area of increased compliance 59A providing for biasing, focusing and/or directing the sideways cutting of the borehole under the side force 15.

In a drilling system where the bottomhole assembly 17 or the drill bit 20 is not rotated during the drilling process the compliant element 57 may be coupled with the bottomhole assembly 17 and/or the drill bit 20 and may provide for continuous biasing, focusing and/or directing of the side cutting under the side force 15 in a selected direction, direction of greater compliance. However, in drilling system where the bottomhole assembly 17 or the drill bit 20 is rotated during the drilling process, the compliant element 57 may be coupled with the bottomhole assembly 17 and/or the drill bit 20 so that the compliant element 57 remains geostationary during the drilling process. In such aspects of the present invention, by maintaining the compliant element 57 geostationary during the directional drilling process, the direction of biasing, focusing and/or directing of the side drilling is maintained during the rotary drilling process.

In certain embodiments of the present invention, the size of the area of increased compliance 59A relative to the size of the compliant element 57 may be altered to control the amount of biasing/focussing/directing of the side force. However, as persons of skill in the art will be aware, making the area of increased compliance 59A too small may not produce the desired increase to the focussing/biasing of the side force 15, as the area may be too small to cause the desired differential in interactions with the sidewall 53.

In some embodiments of the present invention, the collar assembly 55 may be configured to provide that the collar assembly 55 is coupled with the bottomhole to provide that collar assembly 55 is disposed entirely within a cutting silhouette 21 of the drill bit 20, the cutting silhouette 21 comprising the edge-to-edge cutting profile of the drill bit 20. In other embodiments of the present invention, the collar assembly 55, a section of the collar assembly 55, the outer-surface 55A and/or a section of the outer-surface 55A may extend beyond the cutting silhouette 21.

Merely by way of example, the collar assembly 55 may be coupled with the bottomhole assembly 17 to provide that the outer outer-surface 55A is of the order of 1-10 s of millimeters inside the cutting silhouette 21. In other aspects, and again merely by way of example, the collar assembly 55 may be coupled with the bottomhole assembly 17 to provide that at least a portion of the outer-surface 55A extends in the range up to 10 s of or more millimeters beyond the cutting silhouette 21. In aspects where the outer-surface 55A extends beyond the cutting silhouette 21, a gauge cutter proximal to where the outer-surface 55A extends beyond the cutting silhouette 21 will be prevented from cutting into the sidewall 53 by the collar assembly 55 even when the gauge cutter is being directed towards the sidewall 53 under the side force 15.

FIG. 2B is a cross-sectional view through a compliant system for use in the system for steering the drilling system for drilling the borehole of FIG. 2A, in accordance with an embodiment of the present invention. The compliant element 57 viewed in cross-section in FIG. 2B comprises the area of increased compliance 59A and the area of decreased compliance 59B. In certain aspects, there may only be a single area in the compliant element 57 that has an increased or a decreased compliance relative to the rest of and/or the other areas of the compliant element 57. In other aspects, the compliant element 57 may comprise any configuration of compliant sections that produces non-uniform compliance around the compliant element 57

In FIG. 2B, the compliant element 57 is depicted as a solid cylindrical structure, however, in different aspects of the present invention, the compliant element 57 may comprise other kinds of structures, such as a plurality of compliant elements arranged around the bottomhole assembly 17 and configured to couple the collar assembly 55 to the bottomhole assembly 17, an assembly of support elements capable of coupling the collar assembly 55 to the bottomhole assembly 17 and providing lateral movement of the collar assembly 55 and/or the like. In other aspects of the present invention, the collar assembly 55 may itself be a structure with integral compliance, wherein the integral compliance may be selected to be non-uniform around the collar assembly 55 and the collar assembly 55 may be coupled with the bottomhole assembly 17 or maybe a section of the bottomhole assembly 17 without the compliant element 57. In still further aspects, the collar assembly 55 may comprise a plurality of compliant elements, such as pads or the like, the plurality of compliant elements being coupled with the bottomhole assembly 17 and at least one of the compliant elements having a compliance that is different from the other compliant elements.

In an embodiment of the present invention, the area of increased compliance 59A may be disposed on the compliant element 57 so as to be diametrically opposite the area of decreased compliance 59B. In such an embodiment, the compliant element 57 may prevent the collar assembly 55 from moving inwards at the location of the area of decreased compliance 59B, but may allow the collar assembly 55 to move inwards at the area of increased compliance 59A. As a result, the drill bit 20, as it undergoes motion during the directional drilling process, may interact more strongly with the sidewall 53 and/or the gauge cutters 24 may cut deeper into the sidewall 53 in the direction of and/or towards the area of increased compliance 59A (upward as depicted in FIG. 2A). In such an embodiment, as a result of the compliant element 57 having a selected non-uniform compliance, during the drilling process, as a result of the motion of the bottomhole assembly 17 and the drill bit 20 under the side force 15, which as mentioned above may be a continuous motion or a repeated motion depending on how the side force 15 is generated and is not directionally uniform, but rather is a motion in a range of azimuthal directions generally centred on a direction of the side force 15, may provide for the drilling system to preferentially drill towards the area of increased compliance 59A and so cause the drilling system to be steered and may provide for directional drilling of the borehole 50.

In embodiments of the present invention, any non-uniform circumferential compliance of the collar assembly 55 or the compliant element 57 may provide for steering/controlling the drilling system. The amount of differential compliance in the collar assembly 55 and/or the compliant element 57 and/or the profile of the non-uniform compliance of the collar assembly 55 and/or the compliant element 57 may be selected to provide the desired steering response and/or control of the drill bit 20. Steering response and/or drill bit response of a drilling system for a compliance differential and/or a circumferential compliance profile may be determined theoretically, modeled, deduced from experimentation, analyzed from previous drilling processes and/or the like.

In embodiments of the present invention configured for use with a drilling system that does not involve the use of a rotating drill bit or where a housing of the drilling system, e.g., a housing of the bottomhole assembly is non-rotational, the collar assembly 55 and/or the compliant element 57 may be coupled with the drilling system or the housing. In such an embodiment, the drilling system may be disposed in the borehole with the area of increased compliance 59A disposed at a specific orientation to the drill bit 20 to provide for biasing, focusing and/or directing the drilling of the borehole 50 under the side force 15 in the direction of the area of increased compliance 59A. To change the direction of drilling by the drilling system, the position of the area of increased compliance 59A may be changed.

In some embodiments, a positioning device 65—which may comprise a motor, a hydraulic actuator and/or the like—may be used to rotate/align the collar assembly 55 and/or the compliant element 57 to provide for drilling of the borehole 50 by the drilling system in a desired direction. The positioning device 65 may be in communication with a processor 70. The processor 70 may control the positioning device 65 to provide for the desired directional drilling. The processor 70 may determine the correct position of the collar assembly 55 and/or the compliant element 57 in the borehole 50 for the desired direction of drilling from manual intervention, an end point objective for the borehole, a desired drilling trajectory, a desired drill bit response, a desired drill bit interaction with the earth formation, seismic data, input from sensors (not shown)—which may provide data regarding the earth formation, conditions in the borehole 50, drilling data (such as weight on bit, drilling speed and/or the like) vibrational data of the drilling system, dynamic interaction data and/or the like—data regarding the location/orientation of the drill bit in the earth formation, data regarding the trajectory/direction of the borehole and/or the like.

The processor 70 may be coupled with a display (not shown) to display the orientation/direction/location of the borehole 50, the drilling system, the drill bit 20, the collar assembly 55, the compliant element 57, the drilling speed, the drilling trajectory and/or the like. The display may be remote from the drilling location and supplied with data via a connection such as an Internet connection, web connection, telecommunication connection and/or the like, and may provide for remote operation of the drilling process. Data from the processor 70 may be stored in a memory and/or communicated to other processors and/or systems associated with the drilling process.

In another embodiment of the present invention, the steering/drill bit functionality control system may be configured for use with a rotary-type drilling system in which the bottomhole assembly 17 and/or the drill bit 20 may be rotated during the drilling process and, as such, the drill bit 20 and/or the bottomhole assembly 17 may rotate in the borehole 50. In such an embodiment, the collar assembly 55 and/or the compliant element 57 may be configured so that motion of the collar assembly 55 and/or the compliant element 57 is independent or at least partially independent of the rotational motion of the drill bit 20 and/or the bottomhole assembly 17. As such, the collar assembly 55 may be held geostationary in the borehole 50 during the drilling process.

In certain aspects, the collar assembly 55 and/or the compliant element 57 may be a passive system comprising one or more cylinders disposed around the drilling system. The one or more cylinders may in some instances be disposed around the bottomhole assembly 17 of the drilling system. The one or more cylinders may be configured to rotate independently of the drilling system. In such aspects, the one or more cylinders may be configured to provide that friction between the one or more cylinders and the formation may fix, prevent rotational motion of, the one or more cylinders relative to the rotating drilling system. In certain aspects of the present invention, the one or more cylinders may be locked to the bottomhole assembly when there is no weight-on-bit, and hence no drilling of the borehole, and then oriented and unlocked from the bottomhole assembly when weight-on-bit is applied and drilling commences; the friction between the one or more cylinders and the inner surface maintaining the orientation of the one or more cylinders. In some aspects of the present invention, the one or more cylinders may be coupled with the bottomhole assembly 17 by a bearing or the like.

In some embodiments of the present invention, the positioning of the one or more cylinders may be provided, as in a non-rotational drilling system, by the positioning device 65, which may rotate the one or more cylinders to change the location of an active area of the cylinder in the borehole 50 to change the drilling direction and/or the functioning of the drill bit 20. For example, the compliant element 57 may comprise a cylinder and may be rotated around the bottomhole assembly 17 to change a location of the area of increased compliance 59A and/or the area of decreased compliance 59B to change the drilling direction of the drilling system resulting from the dynamic interaction between the collar assembly 55 and the sidewall 53. Alternatively, an active control may be used to maintain a desired orientation/position of the collar assembly 55 and/or the compliant element 57 with respect to the bottomhole assembly 17 during the drilling process. In addition, this type of device could be used in a motor assembly to replace the bent sub. This could bring benefits in terms of tripping the assembly into the hole through tubing and completion restrictions and when drilling straight in rotary mode.

Figures 3A, 3B, 3C:
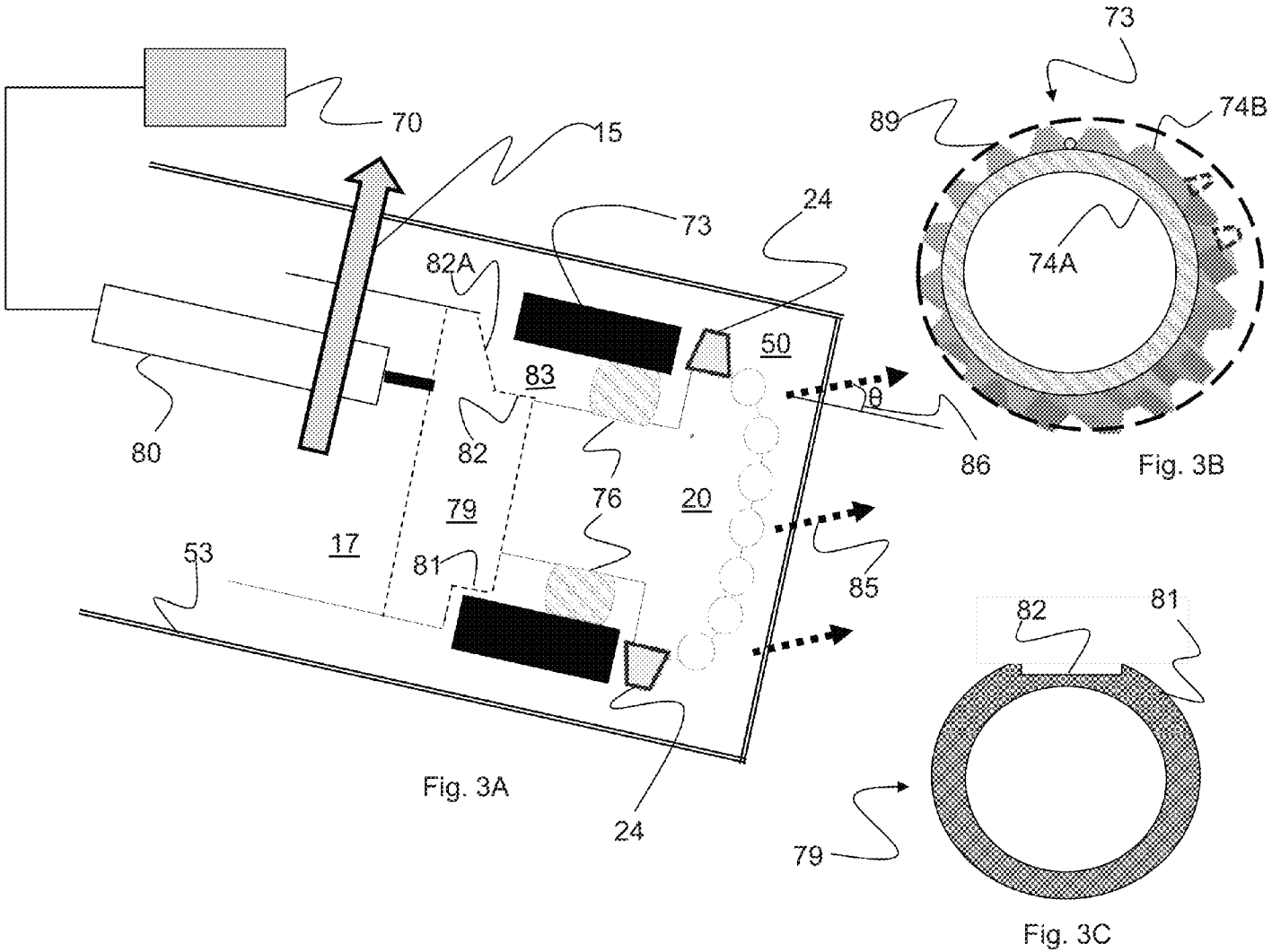
FIGS. 3A-C are schematic-type illustrations of cam control systems for focusing/directing/biasing a side force to provide for steering a directional drilling system, in accordance with an embodiment of the present invention.

FIGS. 3A-C are schematic-type illustrations of a cam control system for focusing, biasing and/or directing motion of a bottomhole assembly and/or drill bit under a side force so as to steer a drilling system, in accordance with an embodiment of the present invention.

FIG. 3A illustrates a directional drilling system with a cam control system, in accordance with an embodiment of the present invention. In FIG. 3A, a drilling system is configured for drilling the borehole 50 through an earth formation. The drilling system comprises the bottomhole assembly 17 disposed at an end of the borehole 50 to be/being drilled. The bottomhole assembly 17 comprises the drill bit 20 that contacts the earth formation and drills the borehole 50. The drill bit 20 may comprise the cutters 23 that may engage a drilling/bottom face of the borehole 50 and the gauge cutters 24 that may engage the sidewall 53 of the borehole. The gauge cutters 24 may be coupled with the drill bit 20, gauge pads or a drill collar attached to the drill bit 20 and/or the like.

In an embodiment of the present invention, a gauge pad assembly 73 may be coupled with the bottomhole assembly 17 by a compliant coupler 76. The gauge pad assembly 73 may comprise a drill collar, a cylinder, non-cutting ends of one or more cutters of the drill but 20 and/or the like.

FIG. 3B illustrates the gauge pad assembly 73 of system FIG. 3A, in accordance with one aspect of the present invention. As depicted, the gauge pad assembly 73 may comprise a cylinder 74A with a plurality of pads 74B disposed on the surface of the cylinder 74A. In some aspects, the plurality of pads 74B may have compliant properties while in other aspects the plurality of pads 74B may be non-compliant and may comprise a metal. In some embodiments of the present invention, the gauge pad assembly 73 may itself be compliant and the compliant gauge pad assembly may be coupled with/an element of the bottomhole assembly 17 without the compliant coupler 76.

In one embodiment of the present invention, a cam 79 may be coupled with the bottomhole assembly 17. The cam 79 may be moveable on the bottomhole assembly 17. In an embodiment of the present invention, the cam 79 may comprise an eccentric/non/symmetrical cylinder. The cam 79 may be moveable so as to contact the gauge pad assembly 73. The gauge pad assembly 73 may be configured to contact the sidewall 53 and/or the drilling-face 54 during the process of drilling the borehole 50. The gauge pad assembly 73 may be directly coupled with the bottomhole assembly 17, coupled to the bottomhole assembly 17 by a coupler 76 or the like. The coupler 76 may comprise a compliant/elastic type of material that may allow for movement of the gauge pad assembly 73 relative to the bottomhole assembly 17.

The cam 79 may be actuated by a controller 80. The controller 80 may comprise a motor, hydraulic system and/or the like and may provide for moving the cam 79 and/or maintaining the cam 79 to be geostationary in the borehole 50 during the drilling process. In some aspects, the cam 79 may comprise a cylinder with an outer surface 81 and an indent 82 in the outer surface 81. In such aspects, during the drilling process, the controller 80 may provide for moving the cam 79 to an active position wherein the outer surface 81 may be proximal to or in contact with the gauge pad assembly 73. In some embodiments of the present invention, there may not be a controller 80 and the cam 79 may, for example, be set to the active position prior to locating the bottomhole assembly 17 in the borehole 50.

In one embodiment of the present invention, the cam 79 may be used to control the interactions between the gauge pad assembly 73 and the sidewall 53 by providing that the properties of the gauge pad assembly 73 are non-uniform around the gauge pad assembly 73. In further embodiments of the present invention, instead of using the cam 79 to change the properties, positioning and/or the like of the gauge pad assembly 73, piezoelectric, hydraulic and/or other mechanical actuators may be used to provide that the gauge pad assembly 73 has non-uniform properties that may and the non-uniform properties may be used to control the dynamic interactions between the gauge pad assembly 73 and the sidewall 53 and/or the drilling-face 54.

In the active position, i.e., where the cam 79 is engaged with the gauge pad assembly 73, movement of the gauge pad assembly 73 in a lateral direction, i.e. towards a central axis of the bottomhole assembly 17 and/or the borehole 50 may be resisted by the cam 79. In the active position, the indent 82 may be separated from the gauge pad assembly 73 by a spacing 83, where the spacing 83 is greater than the spacing between the gauge pad assembly 73 and the outer surface 81 at the other positions around the system. As such, a part of the gauge pad assembly 73 above the indent 82 may have more freedom/ability to move laterally in comparison to the other sections of the gauge pad assembly 73 disposed above the outer surface 81. Consequently, interactions between the gauge pad assembly 73 and the sidewall 53 and/or the drilling-face 54 during the drilling process will not be uniform around the gauge pad assembly 73.

In an embodiment of the present invention, the gauge cutters 24 may engage the sidewall of the borehole during drilling. When the side force 15 is applied, the gauge cutters 24 may be driven by the side force 15 to engage the sidewall 53 and cut in the direction of the side force 15 so providing for directional drilling. In an embodiment of the present invention, the effect of the side force 15 on the engagement between the gauge cutters 24 and the sidewall 53 may be controlled/managed by the cam 79.

In such an embodiment, a section of the gauge pad assembly 73 above the indent 83, which as a result of its position above the indent has more freedom/ability to move laterally in comparison to the other sections of the gauge pad assembly 73 is disposed, may be aligned so that at least a portion of the motion of the drill bit 20 under the side force 15 is directed towards the more freely moving section. As such, the motion of the drill bit 20 under the side force 15 will be greater, less resisted and/or the like in the direction of the more freely moving section. Consequently, the cutters of the drill bit 20 will be able to have greater engagement, sideways cutting in the direction of the more freely moving section and the sideways drilling under the side force will be biased, focused and/or directed towards the more freely moving section.

In certain aspects where the drill bit 20 comprises the gauge cutters 24, a section of the gauge pad assembly 73 above the indent 83, which as a result of its position above the indent has more freedom/ability to move laterally in comparison to the other sections of the gauge pad assembly 73 is disposed, may be aligned so that at least a portion of the motion of the drill bit 20 under the side force 15 is directed towards the more freely moving section to provide for greater engagement in this direction between the gauge cutters 24 and the sidewall 53 compared to the other motional directions of the drill bit induced by the side force 15. In this way, the direction of cutting of the sidewall 53 by the gauge cutters 24 under the side force 15 may be biased, focused and/or directed by the positioning of the cam 79. By holding the cam 79 geostationary in the borehole, the biasing/focusing/directing effect caused by the cam 79 is maintained in the same geostationary direction during the drilling process providing for a continuous effect that results in directional drilling of the borehole. In certain aspects, the cam 79 may be rotated to change the direction of the biasing/focusing/directing so as to control the direction of drilling of the borehole by the drill bit 20 under the side force 15.

In certain aspects of the present invention, the cam 79 may be used to control an offset of the gauge pad assembly 73, either to produce the offset of the gauge pad assembly 73 to steer the drilling system or to mitigate the offset in the gauge pad assembly 73 to provide for straight drilling. In embodiment for controlling operation of the drill bit 20 the cam 79 may be used to control an offset of the gauge pad assembly 73, either to produce the offset of the gauge pad assembly 73 to produce a certain behaviour of the drill bit 20 or to mitigate the offset in the gauge pad assembly 73 to provide a different behaviour of the drill bit 20.

The cam 79 may comprise an eccentric cylinder. In operation, the cam 79 may be engaged with the gauge pad assembly 73 and may provide that at least a section of the gauge pad assembly 73 may be over gauge with respect to the drill bit 20. As a result, the gauge pad assembly 73 being over-gauged may interact with the inner-surface of the borehole 50 in a non-uniform manner. The cam 79 may have a section with a steadily varying outer-diameter to provide for steadily varying the gauge/diameter of at least a section of the gauge pad assembly 73 during a drilling process.

During the directional drilling process, the bottomhole assembly 17 may undergo dynamic motion in the borehole 50 under the side force 15 resulting in dynamic interactions between the bottomhole assembly 17 and the inner-surface of the borehole 50. In an embodiment of the present invention, because of the greater compliance of the gauge pad assembly 73 above the indent 82 compared to the compliance of the gauge pad assembly 73 at a position on the opposite side of the gauge pad assembly 73 relative to the indent, repeated dynamic interactions between the gauge pad assembly 73 and the sidewall 53 and/or the drilling-face 54 will cause the drilling system to drill in a drilling direction 85, where the drilling direction 85 is directed in the direction of the of the indent 82. When engaged, the cam 79 may prevent the gauge pad assembly 73 moving inwards (upwards as drawn), but may allow the gauge pad assembly 73 to move in opposite direction (downwards as drawn). As a result, the drill bit 20 will move, vibrate, upward relative to the gauge pad assembly 73 and hence provide for drilling by the drilling system in an upward direction, towards the indent 82, to produce an upward directed section of the borehole 50. In certain aspects of the present invention, at least an azimuthal component of the side force 15 should be directed towards the section of greater compliance or reduced gauge pad diameter to provide for focusing/biasing the side force 15.

In an embodiment of the present invention, the cam 79 may provide for offsetting the axis of the gauge pad assembly 73 from the axis of the drill bit 20 in a geostationary plane. In certain aspects, the offsetting of the gauge pad assembly 73 by the cam 79 may be provided while the gauge pad assembly 73 is rotating with the drill bit 20 and/or the bottomhole assembly 17.

When using a drilling system to drill a curved section of a borehole, for example a curved section with a 10 degree/100 ft deflection, the actual side tracking of the borehole may be small; for example, in such a curved section, for a forward drilling of the borehole of 150 mm (6 in) the side tracking of the borehole is 0.07 mm. In embodiments of the present invention, because the side tracking to produce curved sections with deflections of the order of 10 degree per 100 feet is small, the system for producing controlled, non-uniform dynamic interactions with the inner surface of the borehole during the drilling process may only need to generate a small deflection of the borehole. In experiments with embodiments of the present invention, control of the dynamic interactions using collar/gauge-pad assemblies with an eccentric circumferential profile relative to a central axis of the bottomhole assembly and/or the drill bit, including eccentric profiles that were over-gauge and/or under-gauge relative to the drill bit, produced steering of curved sections of the borehole with such desired curvatures.

In certain aspects of the present invention, to minimize power requirements, the gauge pad assembly 73 may be mounted on the compliant coupler 76 with the axis of the gauge pad assembly 73 coinciding with the axis of the drill bit 20 and/or the cutting system that may comprise the drill bit 20. In an embodiment of the present invention, steering of the drilling system may be achieved by using the cam 79 to constrain the direction of the compliance of the compliant coupler 76 so the gauge pad assembly 73 may move in one direction, but is very stiff (there is a resistance to radial movement) in the opposite direction. In certain aspects, to steer the drilling system to drill straight, the cam 79 may be engaged to make the movement of the gauge pad assembly 73 system stiff (resistant to radial motion) in all directions.

In an embodiment of the present invention, the gauge pad assembly 73 may comprise a single ring assembly carrying the gauge pads in gauge with the drill bit 20. In certain aspects, a small over or under gauge may be tolerable. In alternative embodiments, the pads on the gauge pad assembly 73 may be mounted on the ring assembly independently and/or may be independently controlled. The gauge pad assembly 73 may be mounted on a stiff compliant structure and may move radially relative to the drill bit 20. The cam 79 may be eccentric and may be configured to be geostationary when steering the drilling system and drawn in, removed and/or the like when the drill string is being tripped or steering is not desired. By maintaining the cam 79 in a geostationary position, the active part of the cam 79, such as the indent 83 or the like, may be maintained in a geostationary position relative to the borehole 50 to provide for drilling of the borehole 50 in a desired direction, for example in the direction of the geostationary indent 83. In certain aspects, the cam 79 may be geostationary and the gauge pads or the like may be free to rotate during the drilling process.

As provided previously, various methods may be used to couple the gauge pad assembly 73 with the drill bit 20 and/or the bottomhole assembly 17. In certain aspects, the mounting may be radially compliant, but may also be capable of transmitting torque and axial weight to the bottomhole assembly 17. In one embodiment of the present invention, the compliant coupler 76, which may be a mounting or the like, may comprise a thin walled cylinder with slots cut in the cylinder to allow radial flexibility but maintain tangential and axial stiffness. Other embodiments may include bearing surfaces to transmit the weight and/or pins and/or pivoting arms, which may be used to transmit the torque.

Using a configuration of the gauge pad assembly 73 and/or the compliant coupling 76 that may keep the indent 82 (or an over-gauge, under-gauge section of the cam 79 or a combination of the cam 79 and the gauge pad assembly 73 or a radially stiff or radially compliant section of the gauge pad assembly 73) geostationary in the borehole 50, the motion of the drilling system may be controlled under the application of the side force 15 to directionally drill the borehole 50.

In some embodiments of the present invention, the processor 75 may be used to manage the controller 80 to provide for rotation of the cam 79 during or between drilling operations to continuously control the direction of the drilling process. In some embodiments, the indent 82 may have a graded profile 82A to provide for a varying depth of the indent 82. In such embodiments, the relative compliance of the gauge pad assembly 73 between a section of the gauge pad assembly 73 above the indent 82 relative to a section of the gauge pad assembly 73 not above the indent 82 may be varied. In this way, in certain embodiments of the present invention, an acuteness (A) 86 of the drilling direction 85 may be variably controlled.

In some aspects of the present invention, a plurality of indents may be provided in the cam 79 to provide for control of the interactions between the gauge cutters 24 and the sidewall 53. The plurality of indents may be disposed at different positions around the circumference of the cam 79 to provide the interaction between the gauge cutters 24 and the sidewall 53 and the resulting desired steering effect. Furthermore, a plurality of cams may be used in conjunction with one or more gauge pad assemblies on the bottomhole assembly 17 to provide different steering effects during the drilling process.

Figures 4A, 4B, 4C:
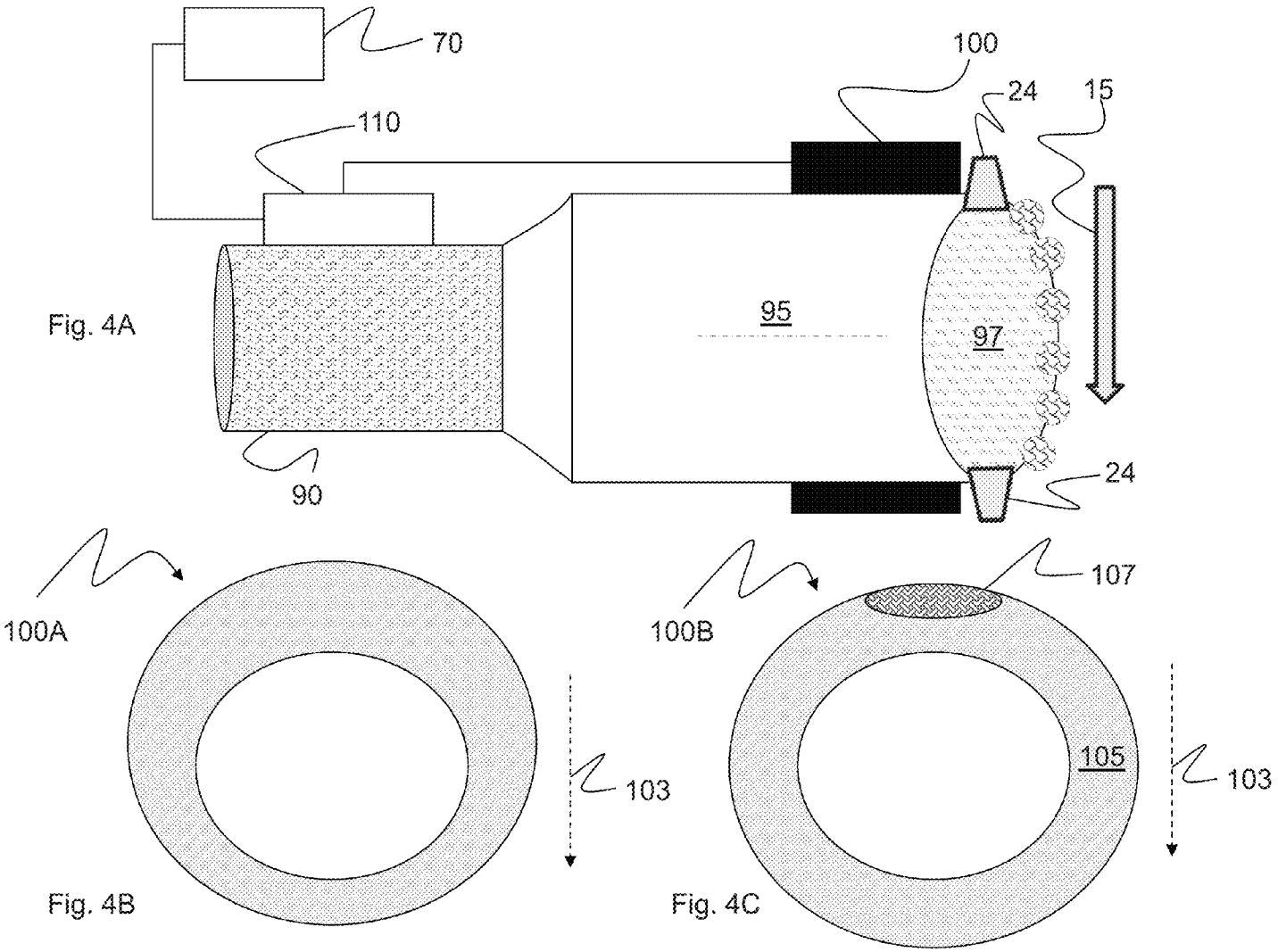
FIGS. 4A-C are schematic-type illustration of active gauge pad systems for controlling a directional drilling system configured for using a side force to directionally drill a borehole, in accordance with an embodiment of the present invention.

FIGS. 4A-C are schematic-type illustration of active gauge pad systems for controlling a directional drilling system configured for using a side force to directionally drill a borehole, in accordance with an embodiment of the present invention. In an embodiment of the present invention, an active gauge pad 100 may be used to control a directional drilling system that uses a side force to provide for directional drilling. The directional drilling system may comprise a drill pipe 90 coupled with a bottomhole assembly 95. The bottomhole assembly 95 may comprise a drill bit 97 for drilling the borehole. The active gauge pad 100 may comprise a drill collar, a gauge pad, a section of the bottomhole assembly, a tubular assembly, a section of the drill bit and/or the like that may interact with the inner surface of the borehole being drilled in a non-uniform manner and, as a result, may affect interactions between the gauge cutters 24 of the drill bit 97 and the inner-wall of the borehole.

The active gauge pad 100 may comprise a disc, a cylinder, a plurality of individual elements—for example a series of pads disposed around the circumference of the bottomhole assembly 95 or the drill pipe 90—that may be coupled with the drilling system and may interact with the inner surface of the borehole being drilled during the drilling process. In certain aspects, to provide for repeated interaction between the active gauge pad 100 or the like and the inner surface of the borehole, the active gauge pad 100 may be coupled with the drilling system so as to be less than 20 feet from the drill bit 97. In other aspects, the active gauge pad 100 may be coupled with the drilling system so as to be less than 10 feet from the drill bit 97. In yet further aspects, the active gauge pad 100 may be proximal to or a part of the drilling bit 97 so that the active gauge pad 100 may have maximum affect on the interactions between the gauge cutters 24 and the inner-wall of the borehole.

In embodiments of the present invention, the active gauge pad 100 may be moveable in the borehole. As such, the active gauge pad 100 may be aligned in the borehole using an actuator or the like to an orientation in the borehole to produce the desired control of the drilling system as a result of the effect of the gauge pad 100 on the interactions between the gauge cutters 24 and the inner-wall. Using a processor or the like to control positioning of the active gauge pad 100 in the borehole, the operation and/or steering of the drilling system may be controlled/managed, and this control/management may, in some aspects of the present invention, occur in real-time.

In FIG. 4A the active gauge pad 100 is coupled with the bottomhole assembly 95 to provide for interaction with the inner surface of the borehole being drilled at a location proximal to the drill bit 97. In a drilling system in which the drill pipe 90, the bottomhole assembly 95 and/or the like are rotated during drilling operations the active gauge pad 100 may be configured to be held geostationary during drilling operations. An actuator, frictional forces and/or the like may be used to hold the active gauge pad 100 geostationary. Merely by way of example, in one embodiment of the present invention, the active gauge pad may be coupled with the bottomhole assembly 95 at a distance of less than 10-20 feet behind the drill bit 97. In other embodiments, the active gauge pad 100 may be coupled with the drill bit 97 or coupled with the bottomhole assembly 95 so as to be within the order of inches from the drill bit 97.

FIG. 4B illustrates one embodiment of the active gauge pad of the system depicted in FIG. 4A. In FIG. 4B, in accordance with an embodiment of the present invention, an active gauge pad 100A may comprise an element that is asymmetric. By coupling the asymmetric active gauge pad with the drill string so that an outer-surface of the gauge pad 100A extends beyond an outer-surface of the drill string, the outer surface of the asymmetric active gauge pad may interact with the inner surface of the borehole being drilled. Since the active gauge pad 100A has a non-symmetrical outer surface, the geostationary positioning of the active gauge pad 100A in the borehole will cause the cutters of the drill bit 97 and/or the gauge cutters 24 to interact in a non-uniform manner with the bottom face of the borehole and the sidewall of the borehole. As such, when the side force 15 is applied to the bottomhole assembly 95 the directional cutting of the formation by the cutters and/or the gauge cutters 24 will depend on the direction of the side force 15 and the properties of the active gauge pad 100A.

Merely by way of example, gauge cutters 24 proximal to a section of the gauge pad 100A with an increased thickness will have their effective cutting ability reduced compared to gauge cutters 24 proximal to sections of the gauge pad 100A with lesser thicknesses. As such, when the side force 15 is applied to the bottomhole assembly 95 and/or the drill bit 97, the bottomhole assembly 95 and/or the drill bit 97 will undergo a stochastic motion, the motion being directed in a plurality of azimuthal angles because of the response of the non-uniform response bottomhole assembly 95 and/or the drill bit 97 to the side force 15, the interaction of the bottomhole assembly 95 and/or the drill bit 97 with the earth formation surrounding the borehole, the side force 15 not being unidirectional, but instead comprises a plurality of component side forces with different azimuthal angles and/or the like. As a result, components of the motion of the bottomhole assembly 95 and/or the drill bit 97 under the side force 15 that are directed towards sections of the gauge pad 100A with lesser thicknesses will cause a greater cutting interaction between the gauge pads proximal to the lesser thickness sections than the components of the side force 15 directed to sections of the active gauge pad 100A with greater thickness. As such, the drill bit 97 will tend to be directed in the same direction as the components of the motion of the bottomhole assembly 95 and/or the drill bit 97 under the side force 15 that are directed towards the sections of the gauge pad 100A with lesser thickness. Consequently, the gauge pad 100A may be used to control the motion of the bottomhole assembly 95 and/or the drill bit 97 under the side force 15, and, as a result, control the direction of drilling of the drill bit 97 under the side force 15.

Merely by way of example, the active gauge pad 100A may be asymmetric in design and may be configured to be coupled with the bottomhole assembly as provided in FIG. 4A. In some embodiments, the active gauge pad 100A may comprise a uniform cylinder and may be arranged eccentrically on the bottomhole assembly to provide for a non-uniform interaction with the inner surface as a result of motion of the drill string under the side force 15.

In certain embodiments, the active gauge pad 100A may comprise a geostationary tube and may be slightly under gauge on one side. In other embodiments, the active gauge pad 100A may be under gauge on one side and over gauge on the opposite side. In some aspects, the active gauge pad 100A may comprise a plurality of geostationary tubes that are under/over gauged circumferentially and that may be coupled around the circumference of the drill pipe 90 and/or the bottomhole assembly 95. In some embodiments of the present invention, the active gauge pad 100A may be configured to provide that the active gauge pad 100A is coupled with the drill string so that the active gauge pad 100A is disposed entirely within a cutting silhouette of the drill bit; the cutting silhouette comprising the edge-to-edge cutting profile of the drill bit. In other embodiments of the present invention, a section or all-of-the active gauge pad 100A may extend beyond the cutting silhouette of the drill bit.

Merely by way of example, the active gauge 100A may be coupled with the drill string to provide that the outer surface of the active gauge 100A is of the order of 1-10 s of millimeters inside the cutting silhouette. In other aspects, and again merely by way of example, the active gauge 100A may be coupled with the drill string to provide that at least a portion of the outer surface of the active gauge pad 100A extends in the range of tenths to 10 s of more millimeters beyond the cutting silhouettes.

FIG. 4C illustrates a further embodiment of the active gauge pad of the system depicted in FIG. 4A. In FIG. 4C an active gauge pad 100B may comprise a collar 105 coupled with an extendable element 107. The collar 105 may comprise a cylinder, disc, drill collar, gauge pad, a section of the bottomhole assembly 95, a section of the drill string, a section of the drill pipe and or the like.

In an embodiment of the present invention, the extendable element 107 may be an element that may be controlled to change the circumferential profile of the collar 105. The extendable element 107 may be controlled/actuated by a controller 110. The controller 110 may comprise a motor, a hydraulic system and/or the like. In an embodiment of the present invention, the controller 110 may actuate the extendable element 107 to extend outward from the bottomhole assembly 95 so as to control the interactions between the bottomhole assembly 95 and/or the drill bit 97 and the inner-surface of the borehole being drilled. Consequently, the extendable element 107 may alter the interactions between cutters on the drill bit 97 and/or the gauge cutters 24 and the inner surface of the borehole being directionally drilled under the side force 15.

In an embodiments of the present invention, a section or the entire extended/partially extended active gauge pad 100B may extend beyond the cutting silhouette of the drill bit so as to limit/reduce interactions between the gauge cutters 24 proximal to the extended element 107 and the inner-wall. Merely by way of example, the active gauge 100B may be coupled with the drill string to provide that at least a portion of the outer surface of the active gauge pad 100B when extended or partially extended extends in the range of tenths of millimeters to 10 s or more millimeters beyond the cutting silhouettes.

In an embodiment of the present invention, the interactions between the gauge cutters 24 and the inner-wall may be controlled by the positioning/extension of the extendable element 107 and, as a result, may provide for controlling the steering of the drilling system under the side force 15. In certain aspects, the processor 70 may receive data regarding a desired drilling direction, data regarding the drilling process, data regarding the borehole, data regarding conditions in the borehole, seismic data, data regarding formations surrounding the borehole and/or the like and may operate the controller 110 to provide the positioning/extension of the extendable element 107 to control the effect of the side force 15 on the gauge cutters 24 so as to steer the drilling system. In certain aspects, the direction of the side force may be monitored to provide as an input to the processor to provide for the control of the side force 15. In an embodiment of the present invention, the extendable element 107 may be extended to adjust the interactions between the gauge cutters 24 and the inner-wall of the borehole being drilled. This may only require extension of the extendable element 107 so that the active gauge pad 100 has a non-uniform shape around a central axis of the drilling system and/or the borehole, and will not require application of a thrust or large force on the inner surface. In fact, it may be desirable to prevent large force interactions between the extendable element 107 and the inner-wall as this may cause damage to the extendable element 107, adversely affect the drilling process and/or the like. As such, the extendable element may be hinged, have some form of compliance and/or the like to reduce the impact-type interaction between the extendable element 107 and the inner-wall.

In certain aspects, however, the extendable element 107 may be positioned and/or extended to exert a force on the inner surface. Merely by way of example, in certain embodiments, the extendable element 107 may exert a force of less than 1 kN on the inner surface to provide for both exertion of a reaction force from the inner surface on the drilling system and control of the dynamic interactions between the drilling system and the inner surface. Operating the extendable element 107 to provide for exertion of forces of less than 1 kN may be advantageous as such forces may not require large downhole power consumption/power sources, may reduce size and complexity of the controller 110 and/or the like.

In an embodiment of the present invention, the bottomhole assembly 95, the drill bit 97, the active gauge pad 100 and/or the like may be configured to have an unevenly distributed mass. The mass of the bottomhole assembly 95, the drill bit 97, the active gauge pad 100 and/or the like may vary circumferentially or the like to provide that the motion of the drill bit 97 under the side force 15 is not directionally uniform. As such, the non-uniform weighting of the drilling system may provide for control of the side force 15 so that some directional components of the side force 15 cause greater interactions between the gauge cutters 24 than other directional components of the side force 15. Merely by way of example, the drill collar which provides weight-on-bit may be a cylinder with a non-uniform weight distribution. In certain aspects, the cylindrical drill collar may be rotated to change the profile of the non-uniform weight/mass distribution in relation to the wellbore to provide a desired control of the drilling system and/or steering of the drilling system.

Figure 5:
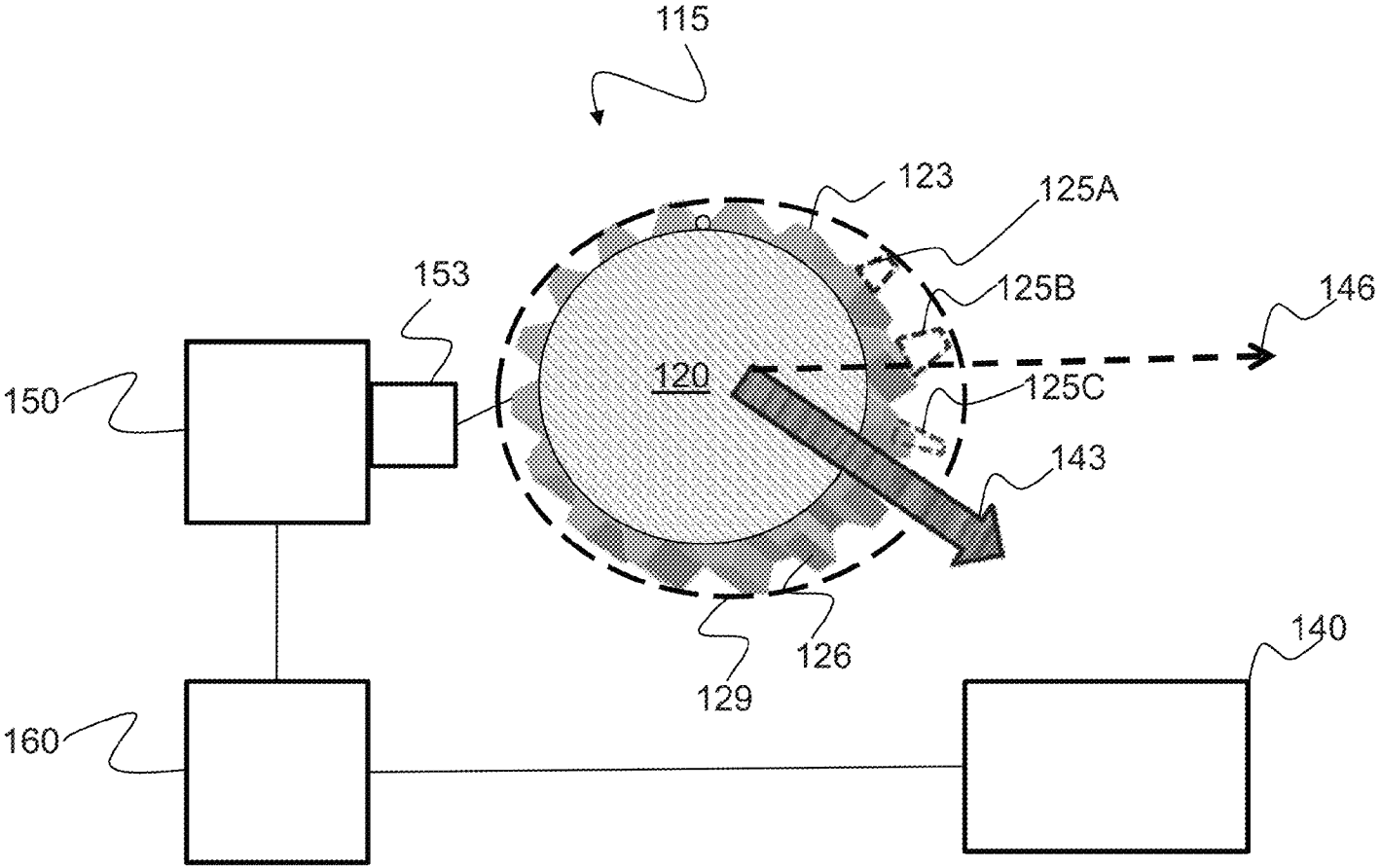
FIG. 5 is a schematic-type illustration of a system for controlling a directional drilling system, in accordance with an embodiment of the present invention.

FIG. 5 is a schematic-type illustration of a system for controlling a directional drilling system 115. In FIG. 5, a cross-section through a drill bit 120 is shown. The drill bit 120 is coupled with a set of gauge pads 123, which are also illustrated in cross-section. In the FIG. 5, the set of gauge pads 123 comprises a closely linked set of numerous individual gauge pads. In embodiments, the set of gauge pads 123 may comprise a smaller amount of gauge pads that are more widely spaced. Merely by way of example there may be less than ten (10) gauge pads in the set of gauge pads 123, there may be less than five (5) gauge pads in the set of gauge pads 123, there may be more than ten (10) gauge pads in the set of gauge pads 123 gauge pads and in some embodiments the set of gauge pads 123 may comprise a single gauge pad. The drill bit 120 may be coupled to a bottomhole assembly 150.

Outer faces of the set of gauge pads 126, which may be referred to as outer-surfaces, borehole wall facing surfaces, borehole wall facing faces, gauge faces, active faces, active surfaces and/or the like face the inner-wall of the borehole (not shown to simplify diagram) during a drilling procedure and may define the gauge of the borehole and/or the combination of the drill bit 120 and the set of gauge pads 123. The outer faces of the gauge pads 126 define a circumference 129 which may be referred to as a gauge of the set of gauge pads 123, an outer-circumference of the set of gauge pads 123, a circumference of the set of gauge pads 123 and/or the like. One or more of the gauge pads in the set of gauge pads 123 may comprise a gauge cutter for cutting a side-wall of the borehole being drilled.

During a drilling procedure, a side force generator 140 may cause a side force 143 to act on the drill bit 120. The side force generator 140 may be a push the bit system, a point the bit system, an arrangement of cutters on the drill bit 120 patterned to develop the side force 143 and/or the like. In some embodiments, the circumference 129 may be asymmetrical. This may be caused by some of the gauge pads, larger gauge pads 125A-C, in the set of gauge pads 123 having larger radial dimensions relative to other gauge pads in the gauge pad set 123. Wherein radial dimensions are dimensions that extend the outer-faces of the gauge pad set 123 away from the circumference of the drill bit 120. In other embodiments, the set of gauge pads 123 may be uniform, but may be eccentrically coupled and/or asymmetrically coupled with the drill bit 120, wherein eccentric coupling and/or asymmetric coupling may comprise a longitudinal axis of the set of drill pads 123 being parallel to a longitudinal axis of the drill bit.

In some embodiments, the circumference 129 may be concentric with an outer circumference of the drill bit 120, but the compression response of the set of gauge pads 123 or a structure (not shown) coupling the set of gauge pads 123 to the drill bit 120 may vary circumferentially. In this way the set of gauge pads 123 will interact with the inner-wall of the borehole in a non-uniform manner, the non-uniformity varying circumferentially depending upon the elasticity of the set of gauge pads 123 at the location on the circumference and/or the elasticity of the structure underlying a gauge pad at the circumferential location. In general, varying the circumferential elasticity of the set of gauge pads 123 and/or a structure (s) coupling the set of gauge pads to the drill bit may provide for the focusing/biasing of the side force as described below.

In some embodiments the set of gauge pads 123 may be coupled with the drill bit 120 and/or the bottomhole assembly 150 so that the gauge pad set may be rotated on the drill bit 120 and/or the bottomhole assembly 150. In some aspects, the set of gauge pads 123 may be adjusted on the drill bit 120 and/or the bottomhole assembly 150 prior to a drilling process. In other aspects, set of gauge pads 123 may be adjusted on the drill bit 120 and/or the bottomhole assembly 150 during the drilling process and/or during a break in the drilling process. Manipulation of the set of gauge pads 123 may be made manually or by a gauge pad controller 153.

In certain aspects, the set of gauge pads 123 may rotate during the drilling process. In such aspects, the larger gauge pads 125A-C may act on the inner-surface of the borehole wall in response to the side force 143 and focus/enhance sideways drilling by the directional drilling system 115. In other embodiments, the set of gauge pads 123 may be kept geostationary during the drilling process or may be rotated at multiple, including negative multiples, frequencies of the rotational frequency of the drill bit 120. In such aspects, a section of the circumference 129 that has a greater radial displacement relative to the circumference of the drill bit 120 may be held at a fixed location relative to the side force 143 or rotated so as to spend a greater period at a location relative to the side force than other locations around the circumference 129. As a result, a sideways drilling effect of the side force 143 may be biased in a sideways drilling direction 146.

In certain embodiments a processor 160 may be capable of communicating with the side force generator 140, the bottomhole assembly 150, the gauge pad controller 153 and/or the like. The process may receive information from sensors monitoring the drilling process, the direction of drilling, properties of the formation being drilled, properties of the formation to be drilled, properties of a reservoir being drilled, properties of a reservoir to be drilled and or the like. The processor may be input with a desired drilling trajectory, borehole location and/or a desired drilling endpoint. The processor 160 may control the side force generator and/or the gauge pad controller 153 to control the directional drilling system 115 to drill the borehole as desired or to achieve a desired objective in the best manner, taking into account wear on bit, rate of penetration, dangers associated with the surrounding formation and/or reservoir and/or the like.

Figure 6:
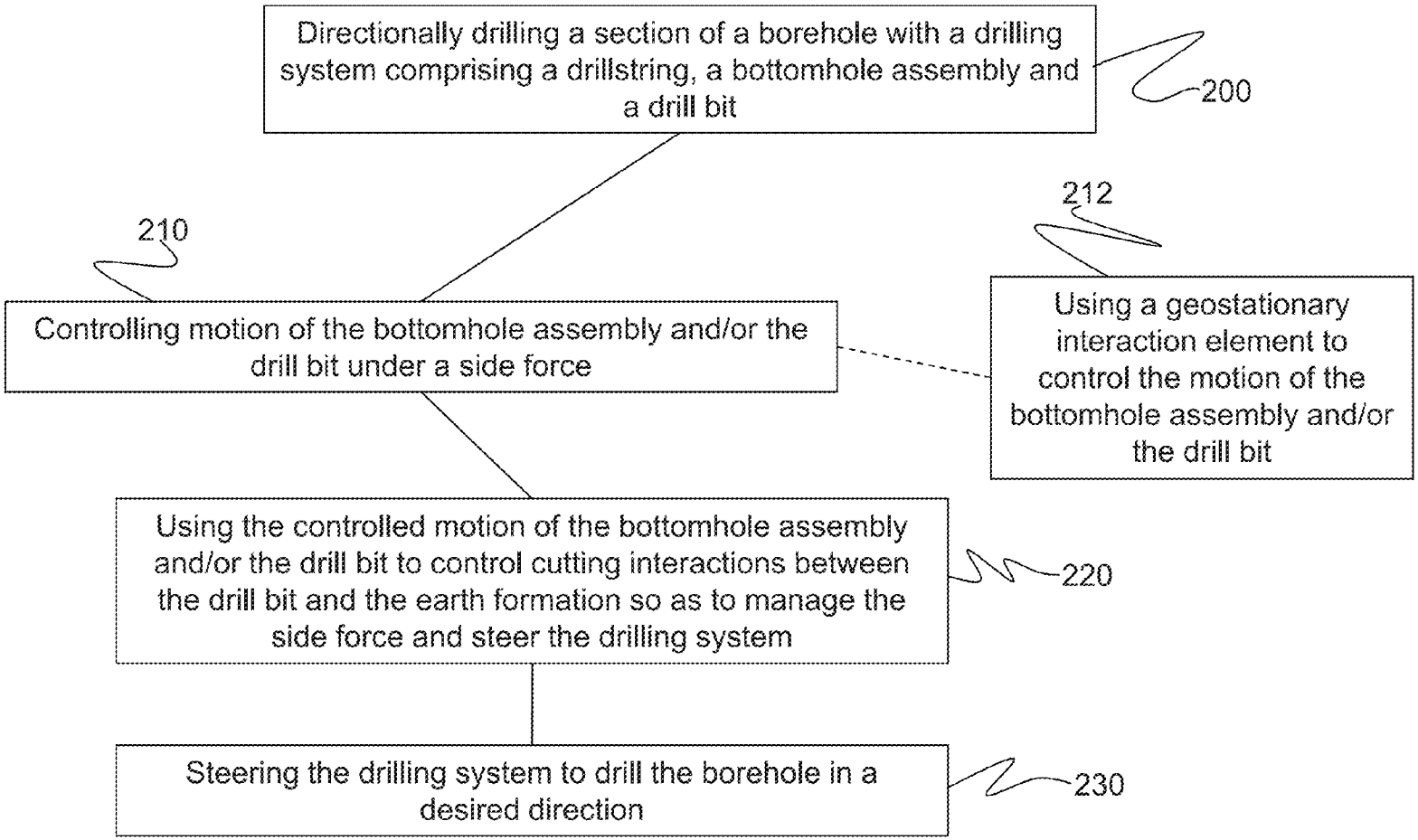
FIG. 6 is a flow-type schematic of a method for managing a directional drilling system to directionally drill a borehole, in accordance with an embodiment of the present invention.

FIG. 6 is a flow-type schematic of a method for managing a side force to steer a drilling system to directionally drill a borehole, in accordance with an embodiment of the present invention. In step 200, a drilling system may be used to drill a section of a borehole through an earth formation. The drilling system may comprise a drill string attached to surface equipment or the like. The drill string may itself comprise a bottomhole assembly that in turn may comprise a drill bit for contacting the earth formation and drilling the section of the borehole through the earth formation. The drill bit may include cutters for cutting into a face of the borehole being drilled and/or gauge cutters for cutting a sidewall of the borehole being drilled.

The bottomhole assembly may be linked to the surface equipment by drill pipe, casing, coiled tubing or the like. The drill bit may be powered by a top drive, rotating table, motor, drilling fluid and/or the like. During directional drilling, a side force is applied to the drill bit to force the drill bit to cut in a certain direction. The side force may be generated by any known method, such as arrangement of the cutters on the drill bit, forcing an extendable pad into contact with the sidewall to generate a reactionary side force on the drill bit, bending the drill string, using a bent sub to provide that the weight-on-the-drill-bit pushes the drill bit with a side force and/or the like In practice, the side force generated in the directional drilling process may not be unidirectional and may vary directionally with time as the variables in its generation, such as movement of the extendable pad in the borehole during the drilling process, the position of the drill bit during the drilling process, the reaction forces generated by the side-wall of the earth formation, the relative position of a bent-sub or the like with respect to the drill bit and/or the like vary during the directional drilling process. Additionally, the motion of the bottomhole assembly and/or the drill bit under application of the side force may not be unidirectional, but may instead comprise a motion in a range of azimuthal angles resulting from variance in direction of the side force, interactions between the drilling system and the earth formation being drilled, non-uniform interactions between cutters and the earth formation, variances in the properties of the earth formation, noise associated with the drilling process and/or the like.

As such, during the directional drilling process, the motion of the bottomhole assembly and/or the drill bit even when the side force is applied is not unidirectional, but is instead varies and/or comprises a plurality of different directional motions. The result of this varying direction of motion is that the direction of drilling by the drill bit also varies. The greater the variations in the directional motion of the bottomhole assembly and/or the drill bit, the greater the variation in the resulting directional drilling.

In step 210, the varying directional motion and/or the different directional components of motion of the bottomhole assembly and/or the drill bit may be controlled. In embodiments of the present invention, motion of the bottomhole assembly and/or the drill bit may be controlled by controlling interactions between the bottomhole assembly and/or the drill bit with the inner-surface of the borehole resulting from the motion of the bottomhole assembly and/or the drill bit and/or by weighting the bottomhole assembly and/or the drill bit.

In certain aspects of the present invention, by controlling the motion of the bottomhole assembly and/or the drill bit under the side force, cutting interactions between cutters on the drill bit and the earth formation being drilled may be controlled so as to provide for directional cutting.

Merely by way of example, controlling motion of the bottomhole assembly and/or the drill bit under the side force may provide for controlling cutting interactions between the gauge cutters on the drill bit and the sidewall. When a side force is applied to the drill bit, the side force forces the gauge cutters in a direction coincident with the side force to cut into sidewall. By keeping the direction of the side force relatively uniform with a desired direction of drilling, directional drilling is achieved. However, as observed above, the side force, because of the drilling variables and variables in its generation, is not generally unidirectional. As a result, the directional drilling of the drilling system under the directionally varying side force also varies around the desired direction. In certain circumstances, there may a feedback effect and the side force may produce a drilling direction that is considerably different from the desired direction sought by the generation of the side force. Furthermore, where the side force is generated by cutter-pattern on the drill bit, the direction of drilling may be unrefined and may be difficult to control.

To provide for the control of the cutting interactions and the sidewall in step 210, a geostationary interaction element may be used in step 212. The interaction element may be any element that directionally biases the motion of the bottomhole assembly and/or the drill bit under the side force and, thus, directionally biases the ability of the cutters to cut the earth formation. Merely by way of example, the geostationary element may be a cylinder, collar, gauge pad and/or the like eccentrically coupled with the bottomhole assembly and/or the drill bit or may be an asymmetric cylinder, collar, gauge pad and/or the like centrally coupled with the bottomhole assembly and/or the drill bit.

In certain, aspects, the eccentrically coupled cylinder or asymmetric cylinder may have an effect on the ability of the gauge cutters to cut into the sidewall, and this effect that will vary circumferentially around the cylinder collar, gauge pad and/or the like. For example, because the cylinder collar, gauge pad and/or the like is eccentrically coupled or asymmetric, there will be sections of the cylinder collar, gauge pad and/or the like (hereinafter referred to as "distant sections") that are disposed further away from a central longitudinal axis of the bottomhole assembly and/or the drill bit than the other sections of the cylinder collar, gauge pad and/or the like. Similarly, because the cylinder collar, gauge pad and/or the like is eccentrically coupled or asymmetric, there will be sections of the cylinder collar, gauge pad and/or the like (hereinafter referred to as "near sections") that are disposed closer to the central longitudinal axis of the bottomhole assembly and/or the drill bit than the other sections of the cylinder collar, gauge pad and/or the like. In certain aspects of the present invention, the cylinder collar, gauge pad and/or the like may be coupled with the bottomhole assembly and/or the drill bit so that when a side force is applied to the bottomhole assembly and/or the drill bit the gauge cutter(s) proximal to the distant sections are either prevented from cutting into the sidewall or the cutting engagement between the proximal gauge cutter(s) and the sidewall is inhibited. In such aspects, the gauge cutter(s) proximal to the near sections will not be as inhibited or will be uninhibited in their cutting interactions with the sidewall by the near sections because of the geometry of the cylinder, collar, gauge pad and/or the like. As such, the cylinder collar, gauge pad and/or the like may provide for controlling the cutting interactions between the gauge pads and the sidewall under a side force.

As noted previously, a side force for controlling directional drilling will not be unidirectional during a drilling process, but will vary directionally and/or comprise a plurality of different directional components because of changing conditions during the drilling process. In an embodiment of the present invention, the cylinder, collar, gauge pad and/or the like may be coupled with the bottomhole assembly and/or the drill bit so that cutting of the bottom face of the borehole by the cutters and/or the sidewall by the gauge cutters under the directionally varying side-force is biased to be coincident with one or a small angular range of the directionally varying side forces. In this way, the direction of sideways cutting by the gauge cutters under the side force may be controlled.

As observed above, in some embodiments of the present invention, instead of the cylinder collar, gauge pad and/or the like being asymmetric or eccentrically coupled with the bottomhole assembly and/or the drill bit, the cylinder collar, gauge pad and/or the like may have a circumferentially varying compliance that varies the cutting capabilities of the gauge cutters around the inner-diameter of the borehole being drilled. In further embodiments, the bottomhole assembly and/or the drill bit may have a weight distribution that varies radially and provides for biasing, focusing and/or directing a motion of the bottomhole assembly and/or the drill bit under the side force. In such embodiments, the non-uniform weighting of the bottomhole assembly 95 and/or the drill bit 97 may bias/focus/direct the motion of the bottomhole assembly and/or the drill bit, thus, biasing/focusing/directing the cutting capabilities of the cutters and/or the gauge cutters of the drill bit. In certain aspects of the present invention, the interaction element may comprise an extendable pad that may be pushed outward from the bottomhole assembly and/or the drill bit to adjust the interactions between the bottomhole assembly and/or the drill bit, and as a result the cutting interactions between the cutters and/or the gauge cutters and the inner-surface of the borehole.

In a non-rotating drilling system, the interaction element may be coupled with the bottomhole assembly and/or the drill bit in a configuration so that when a side force is applied to the bottomhole assembly and/or the drill bit a selected direction of drilling will be preferred/biased and the drill bit will preferentially cut in the selected direction. In a rotating drilling system, in accordance with an embodiment of the present invention, the interactions element is coupled with the bottomhole assembly and/or the drill bit to be geostationary during the rotary drilling process. In this way, the selected, biased drilling direction remains constant as the side force is applied during the rotational drilling of the borehole. In aspects of the present invention where the interaction element is an extendable element that extendable element may be periodically extended, where the periodic extension is a multiple of the period of rotation of the bottomhole assembly and/or the drill bit so that the effect of the extendable element is geostationary with respect to the rotating drilling system.

Generally, the borehole being drilled is a borehole in the earth formation with essentially a cylindrical inner surface. As such, in some aspects the interaction element may comprise an element with a profile that is non-uniform with respect to a center axis of the drill string and/or the borehole. Merely by way of example, the interaction element may comprise an eccentric cylinder coupled with the bottomhole assembly; wherein as coupled with the bottomhole assembly a centre axis of the eccentric cylinder is not coincident with a centre axis of the bottomhole assembly. In another example, the interaction element may comprise a series of pads disposed around the bottomhole assembly and configured to contact cylindrical inner surface of the borehole during the drilling process, wherein at least one of the pads is configured to extend outward from the bottomhole assembly by a lesser or greater extent than the other pads.

In other embodiments, the interaction element may comprise an element with non-uniform compliance. Merely by way of example, the compliant element may comprise an element with certain compliance and a section of the element with an increased or decreased compliance relative to the certain compliance of the rest of the element, and be configured to provide that at least a part of the area of increased or decreased compliance and at least a part of the element with the certain compliance may each contact the cylindrical inner surface during the drilling process as a result of dynamic motion of the bottomhole assembly. In some embodiments of the present invention, an actuator may be used to change the characteristics of the interaction element, such as to actuate the interaction element from an element that interacts uniformly with the inner surface of the borehole to one that interacts in a non-uniform manner with the inner surface.

In certain embodiments of the present invention, the interaction element, whether being an element with a non-uniform profile, a non-uniform compliance and/or the like, may not be configured to exert a pressure on the inner surface or to thrust against the inner surface, but rather may be passive in nature and interact with the inner surface due to dynamic motion of the drill string during the drilling process. For example, the interaction element may comprise an extendible element that is extended outward from the drill string. In some aspects, forces may be applied by the extendible element on to the inner surface, but for simplicity and economic reasons, the forces may only be small in nature, i.e. forces less than about 1 kN.

In some embodiments of the present invention, the interaction element may be configured so as not to extend beyond and/or be disposed entirely within a silhouette of the cutters of the drill bit. In other embodiments, the interaction element may have at least a portion that may extend beyond the silhouette of the drill bit. In certain aspects of the present invention, the interaction element may extend in the range of 1 mm to 10 s of millimeters outside the silhouette of the drill bit and/or the cutters, with such an extension range providing for steering/controlling the drilling system.

In certain aspects of the present invention where the interaction element comprises one or more extendable elements, the one or more extendable elements may be extended so as not to extend beyond and/or be disposed entirely within a silhouette of the cutters and/or the drill bit. In other aspects, the one or more extendable elements may be extended to provide that at least a portion of the one or more extendable elements extend beyond the silhouette of the cutters and/or the drill bit. Steering of the drilling system may be provided in certain embodiments of the present invention by extending the one or more extendable elements in the range of 1-10 mm beyond the silhouette of the cutters and/or the drill bit. In such embodiments, unlike directional drilling systems using reaction forces, thrust against the borehole wall for steering, only a small amount of power and/or minimal downhole equipment may be used/needed to actuate and/or maintain the extendable elements in the desired extension beyond the silhouette of the cutters and/or the drill bit.

In step 220, cutting interactions between the drill bit and the earth formation are in controlled by the motion of the bottomhole assembly and/or the drill bit. In an embodiment of the present invention, the interaction element may be selectively positioned in the borehole to provide for selective biasing of the direction of cutting by the cutters and/or gauge cutters under the application of the side force. In certain aspects, the interaction element may be re-positioned on the bottomhole assembly and/or the drill bit prior to drilling a further section of the borehole. In embodiments where an actuator, such as a cam or the like, may be used to change the location of a response provided by the interaction element with respect to the bottomhole assembly and/or the drill bit, the cam may be selectively positioned and/or repositioned during the drilling process.

In some embodiments of the present invention, means for controlling the position in the borehole, orientation in the borehole, location and/or orientation on the drill string of the interaction element may be used to move the interaction element during the drilling process. This may provide for real-time management of the side force. The means for controlling may comprise an actuator that may be driven by a motor, hydraulic forces derived from drilling fluids flowing in the borehole and/or the like.

In step 230, the drilling system is steered to drill the borehole in a desired direction. In an embodiment of the present invention, a desired direction for the section of the borehole to be drilled may be determined and the interaction element may be coupled with the bottomhole assembly and/or the drill bit and positioned in the borehole so as to focus/bias a direction of sidewall cutting by the gauge cutters so as to steer the drilling system to drill the section of the borehole in the desired direction. In certain aspects, a processor may control the position, orientation and/or the like of the geostationary interaction element used to control. In certain embodiments, data from sensors disposed on the drill string, data from sensors disposed in the borehole, data from sensors disposed in the earth formation proximal to the borehole, seismic data and/or the like may processed by the processor to determine a position orientation of the device used to control the dynamic interactions for the desired drilling direction. The sensors may include accelerometers, gravitometers and/or the like coupled with the bottomhole assembly and configured to determine location, orientation of the bottomhole assembly and forces acting on and motion of the bottomhole assembly in the borehole.

Data regarding operation of the drill string and/or the drill bit during the drilling process may be sensed. The data may include such things as weight-on-bit, rotation speed of the drilling system, hook load, torque and/or the like. Additionally, data may be gathered from the borehole, the surface equipment, the formation surrounding the borehole and/or the like and data may be input regarding intervention/drilling processes being or about to be implemented in the drilling process. For example, pressures and/or temperatures in the borehole and the formation may be determined, seismic data may be acquired from the borehole and/or the formation, drilling fluid properties may be identified and/or the like.

The sensed data regarding the drilling system and/or data regarding the earth formation and/or conditions in the borehole being drilled and/or the like may be processed. The processing may be determinative/probabilistic in nature and may identify current and/or potential future states of the drilling system. For example, conditions and/or potential drilling system conditions such as inefficient performance of the drill bit, stalling of the drill bit and/or the like may be identified.

In some embodiments of the present invention, a processor receiving sensed data may be used to manage the controlling/directing of the side force. For example, magnetometers, gravimeters, accelerometers, gyroscopic systems and/or the like may determine amplitude, frequency, velocity, acceleration and/or the like of the drilling system to provide for understanding of any motion of the drilling system and/or the effects/direction of the side force. The data from the sensors may be sent to the processor for processing and values regarding the direction of the side force or the like may be displayed, used in a control system for controlling the positioning of the interaction element, processed with other data from the earth formation, wellbore and/or the like to provide for management of the control system for controlling the directional cutting by the gauge cutters under the side force. Merely by way of example, communication of the sensed data to the processor may be made via a telemetry system, a fiber optic, a wired drill pipe, wired coiled tubing, wireless communication and/or the like.

The invention has now been described in detail for the purposes of clarity and understanding. However, it will be appreciated that certain changes and modifications may be practiced within the scope of the appended claims. Moreover, in the foregoing description, for the purposes of illustration, various methods and/or procedures were described in a particular order. It should be appreciated that in alternate embodiments, the methods and/or procedures may be performed in an order different from that described.

What is claimed is:

1. A system for controlling a rotary drilling system, the rotary drilling system comprising a drill string and a bottomhole assembly coupled with a drill bit, to directionally drill a borehole through an earth formation, comprising:

means for applying a side force to the bottomhole assembly to generate lateral motion of the bottomhole assembly in the borehole and provide for side cutting by the drill bit;

a control element configured in use to control the lateral motion of said bottomhole assembly to direct the side cutting and provide for the directional drilling of the borehole, wherein the control element is disposed circumferentially around the bottomhole assembly or drill bit and eccentrically coupled with the bottomhole assembly or drill bit so as to provide in use an interaction with a sidewall of the borehole that varies circumferentially around the bottomhole assembly or drill bit, and wherein the control element is configured in use to remain geostationary on the rotary drilling system; and means for rotating the geostationary element around the drill string to position the geostationary element on the drill string.

2. The system of claim 1, wherein the drill bit comprises one or more gauge cutters.

3. The system of claim 1, wherein the control element comprises a sleeve eccentrically coupled with the bottomhole assembly or the drill bit.

4. The system of claim 2, wherein the control element comprises a sleeve eccentrically coupled with the bottomhole assembly or the drill bit and configured to provide for inhibiting the lateral motion of the bottomhole assembly over a range of azimuthal angles and to provide for less or no inhibition of lateral motion of the bottomhole assembly over a complementary range of azimuthal angles.

5. The system of claim 1, wherein the control element comprises a plurality of gauge pads asymmetrically coupled with the bottomhole assembly and configured to provide for the directional drilling by inhibiting the radial motion of the bottomhole assembly over a range of azimuthal angles.

6. The system of claim 5, wherein one or more of the plurality of gauge pads is moveable relative to a central axis of the bottom-hole assembly and the one or more moveable gauges pads may be moved to alter the range of azimuthal angles.

7. The system of claim 1, wherein the means for applying the side force to the drill bit comprises arranging cutters on the drill bit so as to develop a side force acting on the drill bit when the drill bit drills the borehole.

8. The system of claim 1, wherein the means for applying the side force to the drill bit comprises using a flexible member and a plurality of stabilizers to use the weight-on-bit to generate the side force.

9. The system of claim 1, wherein the means for applying the side force to the drill bit comprises using a fixed bend in the drilling system and a plurality of stabilizers to use the weight-on-bit to generate the side force.

10. The system of claim 1, wherein the means for applying the side force to the drill bit comprises manipulating the drill bit to point in a direction away from a centre axis of the borehole.

11. The system of claim 1, wherein the means for applying the side force to the drill bit comprises using an actuator coupled with the bottomhole assembly to apply a force against the inner-wall to generate a reactionary side force on the bottomhole assembly.

* * * * *

UNITED STATES PATENT AND TRADEMARK OFFICE

CERTIFICATE OF CORRECTION

PATENT NO. : 8,720,605 B2
APPLICATION NO. : 13/324681
DATED : May 13, 2014
INVENTOR(S) : Michael Charles Sheppard, Ashley Bernard Johnson and Geoffrey Downton It is certified that error appears in the above-identified patent and that said Letters Patent is hereby corrected as shown below:

On the title page

Item (75) Inventors:

Inventor name corrected from "Geoff Downton" to --Geoffrey Downton--.

Signed and Sealed this
Twenty-third Day of February, 2016

Michelle K. Lee

Michelle K. Lee
*Director of the United States Patent and Trademark Office*